US010196888B2

(12) United States Patent
Crews et al.

(10) Patent No.: US 10,196,888 B2
(45) Date of Patent: Feb. 5, 2019

(54) PLACEMENT AND USES OF LATERAL ASSISTING WELLBORES AND/OR KICK-OFF WELLBORES

(71) Applicant: BAKER HUGHES INCORPORATED, Houston, TX (US)

(72) Inventors: James B. Crews, Willis, TX (US); Robert Samuel Hurt, Tomball, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 682 days.

(21) Appl. No.: 14/870,880

(22) Filed: Sep. 30, 2015

(65) Prior Publication Data

US 2016/0230526 A1 Aug. 11, 2016

Related U.S. Application Data

(60) Provisional application No. 62/058,503, filed on Oct. 1, 2014.

(51) Int. Cl.

| | |
|---|---|
| ***E21B 43/30*** | (2006.01) |
| ***E21B 43/17*** | (2006.01) |
| ***E21B 43/26*** | (2006.01) |
| ***E21B 7/06*** | (2006.01) |
| ***E21B 37/06*** | (2006.01) |
| ***E21B 43/267*** | (2006.01) |

(52) U.S. Cl.

CPC ..... *E21B 43/305* (2013.01); *E21B 7/06* (2013.01); *E21B 37/06* (2013.01); *E21B 43/17* (2013.01); *E21B 43/26* (2013.01); *E21B 43/267* (2013.01); *E21B 43/30* (2013.01)

(58) Field of Classification Search

CPC ..... E21B 43/305; E21B 37/06
USPC ..... 166/280.1
See application file for complete search history.

(56) References Cited

U.S. PATENT DOCUMENTS

| | | | |
|---|---|---|---|
| 2001/0045280 | A1 | 11/2001 | Longbottom et al. |
| 2011/0192601 | A1 | 8/2011 | Bahorich et al. |
| 2013/0032350 | A1 | 2/2013 | Potapenko et al. |
| 2013/0240211 | A1 | 9/2013 | East et al. |
| 2014/0014338 | A1 | 1/2014 | Crews et al. |

FOREIGN PATENT DOCUMENTS

| | | | |
|---|---|---|---|
| WO | 2006002325 | A2 | 1/2006 |

OTHER PUBLICATIONS

Int'l Search Report and Written Opinion in PCT/US2015/053410, dated Dec. 7, 2015.

*Primary Examiner* — William D Hutton, Jr.
*Assistant Examiner* — Ashish K Varma
(74) *Attorney, Agent, or Firm* — Mossman, Kumar & Tyler, P.C.

(57) ABSTRACT

Improving the flow of hydrocarbons from shale lateral wellbores in unconventional wellbores may be accomplished with various configurations of assisting lateral wellbores and/or kick-off wellbores from primary lateral wellbores and/or secondary or assisting lateral wellbores. By extending fracture networks from adjacent lateral wellbores and/or adjacent kick-off wellbores so that the fracture networks from different wellbores are in fluid communication with one another, the flow of various fluids between the adjacent wellbores provides another dimension of control over the wellbores and fracture networks used to recover hydrocarbons from the shale intervals of interest.

15 Claims, 18 Drawing Sheets

PLACEMENT AND USES OF LATERAL ASSISTING WELLBORES AND/OR KICK-OFF WELLBORES

CROSS-REFERENCE TO RELATED APPLICATION

This application claims the benefit of U.S. Provisional Patent Application Ser. No. 62/058,503 filed Oct. 1, 2014, incorporated herein by reference in its entirety.

TECHNICAL FIELD

The present invention relates to methods of recovering hydrocarbons from subterranean formations using multiple wellbores, and more particularly relates, in one non-limiting embodiment, to methods of recovering hydrocarbons from unconventional shale subterranean formations using multiple wellbores that are substantially parallel and adjacent to one another and/or are kicked-off from another lateral wellbore.

TECHNICAL BACKGROUND

It is well known that hydrocarbons (e.g. crude oil and natural gas) are recovered from subterranean formations by drilling a wellbore into the subterranean reservoirs where the hydrocarbons reside, and using the natural pressure of the hydrocarbon or other lift mechanism such as pumping, gas lift, electric submersible pumps (ESP) or another mechanism or principle to produce the hydrocarbons from the reservoir. Conventionally most hydrocarbon production is accomplished using a single wellbore. However, techniques have been developed using multiple wellbores, such as the secondary recovery technique of water flooding, where water is injected into the reservoir to displace oil. The water from injection wells physically sweeps the displaced oil to adjacent production wells. Potential problems associated with water flooding techniques include inefficient recovery due to variable permeability or similar conditions affecting fluid transport within the reservoir. Early breakthrough is a phenomenon that may cause production and surface processing problems.

Hydraulic fracturing is the fracturing of subterranean rock by a pressurized liquid, which is typically water mixed with a proppant (often sand) and chemicals. The fracturing fluid is injected at high pressure into a wellbore to create, in shale for example, a network of fractures in the deep rock formations to allow hydrocarbons to migrate to the well. When the hydraulic pressure is removed from the well, the proppants, e.g. sand, aluminum oxide, etc., hold open the fractures once fracture closure occurs. In one non-limiting embodiment chemicals are added to increase the fluid flow and reduce friction to give "slickwater" which may be used as a lower-friction-pressure placement fluid. Alternatively in different non-restricting versions, the viscosity of the fracturing fluid is increased by the addition of polymers, such as crosslinked or uncrosslinked polysaccharides (e.g. guar gum) or by the addition of viscoelastic surfactants (VES).

Recently the combination of directional drilling and hydraulic fracturing has made it economically possible to produce oil and gas from new and previously unexploited ultra-low permeability hydrocarbon bearing lithologies (such as shale) by placing the wellbore laterally so that more of the wellbore, and the series of hydraulic fracturing networks extending therefrom, is present in the production zone permitting more production of hydrocarbons as compared with a vertically oriented well that occupies a relatively small amount of the production zone. "Laterally" is defined herein as a deviated wellbore away from a more conventional vertical wellbore by directional drilling so that the wellbore can follow the oil-bearing strata that are oriented in a non-vertical plane or configuration. In one non-limiting embodiment, a lateral wellbore is any non-vertical wellbore. In another non-limiting embodiment, a lateral wellbore is defined as any wellbore that is at an inclination angle from vertical ranging from about 45° to about 135°. It will be understood that all wellbores begin with a vertically directed hole into the earth, which is then deviated from vertical by directional drilling such as by using whipstocks, downhole motors and the like. A wellbore that begins vertically and then is diverted into a generally horizontal direction may be said to have a "heel" at the curve or turn where the wellbore changes direction and a "toe" where the wellbore terminates at the end of the lateral or deviated wellbore portion. The "sweet-spot" of the hydrocarbon bearing reservoir is an informal term for a desirable target location or area within an unconventional reservoir or play that represents the best production or potential production. The combination of directional drilling and hydraulic fracturing has led to the so-called "fracking boom" of rapidly expanding oil and gas extraction in the US beginning in about 2003.

Improvements are always needed in the driller's ability to find and map sweet-spots to enable wellbores to be placed in the most productive areas of the reservoirs. Sweet-spots in shale reservoirs may be defined by the source rock richness or thickness, by natural fractures present therein or by other factors. Conventionally, geological data, e.g. core analysis, well log data, seismic data and combinations of these are used to identify sweet-spots in unconventional plays.

SUMMARY

There is provided in one non-limiting embodiment a method for improving a flow of a hydrocarbon from at least one lateral wellbore in a subterranean shale formation having at least one assisting lateral wellbore substantially adjacent to and substantially parallel to the primary lateral wellbore. The method includes, in any order, hydraulically fracturing at least one first shale interval in the formation from the at least one primary lateral wellbore in the direction of the at least one assisting lateral wellbore to create a first fracture network while also hydraulically fracturing the at least one first shale interval from the at least one assisting lateral wellbore in the direction of the at least one primary lateral wellbore bore to create a second fracture network where the second fracture network and the first fracture network are in fluid communication with each other. The method further includes a sub-method including, but not necessarily limited to, (1) cleaning up the at least one primary lateral wellbore which, in turn, includes introducing a cleanup fluid from the at least one assisting lateral wellbore through the second fracture network into the first fracture network and the at least one primary lateral wellbore to remove at least one contaminant or frac treatment material therefrom; (2) inducing closure of at least one fracture of the first fracture network by withdrawing fluid from the first fracture network by causing fluid flow towards and/or into the second fracture network, and towards and/or into the at least one assisting lateral wellbore; (3) placing proppant in at least the first fracture network and treating the first fracture network and the second fracture network with a treatment fluid; and (4) combinations of (1) and (2). The method also includes producing the hydrocarbon from at least one lateral wellbore.

There is additionally provided in one non-restrictive version, a method for improving a flow of a hydrocarbon from at least one lateral wellbore in a shale interval in a subterranean formation, where the method includes, from the primary lateral wellbore, drilling at least one kick-off wellbore in the shale interval away from the at least one primary lateral wellbore, hydraulically fracturing the shale interval from the kick-off wellbore, simultaneously with or subsequent to the hydraulically fracturing, introducing a proppant-laden fluid into the at least one primary lateral wellbore and the at least one kick-off wellbore, and subsequent to the introduction of the proppant-laden fluid, introducing a flush fluid into the at least one primary lateral wellbore and the at least one kick-off wellbore such that displacement of the flush fluid causes the proppant-laden fluid to be placed into the at least one kick-off wellbore preferential to the at least one primary lateral wellbore.

Further there is provided in one non-limiting embodiment a method for improving a flow of a hydrocarbon from at primary lateral wellbore in a subterranean shale formation and at least two assisting lateral wellbores substantially adjacent to and substantially parallel to the primary lateral wellbore. The method includes hydraulically fracturing of a fracture intervals of at least one first shale interval in the formation from the one primary lateral wellbore and the at least two assisting laterals wellbore to initially create a near to far-field fracture network around each wellbore (the primary and the at least two assisting lateral wellbores), where the near to far-field fracture networks around the at least two assisting laterals are created prior to the primary lateral near to far-field fracture network fracturing process or simultaneously during the primary lateral wellbore near to far-field network fracturing process, and if created simultaneously then subsequently stopping hydraulic fracturing from the at least two assisting lateral wellbores at the at least one first shale frac interval, to then continue hydraulically fracturing from the one primary lateral wellbore to intersect with proppant-laden fluid at least one of the two assisting laterals near wellbore fracture networks and in one non-limiting embodiment by intersecting one or both assisting lateral wellbores with the proppant-laden slurry from the primary lateral. Further, the proppant-laden slurry fracturing fluid intersecting and/or reaching at least one of the at least two assisting laterals near wellbore fracture networks and/or assisting lateral wellbores from the primary lateral wellbore is to produce a conductive fracture or fracture network between the primary lateral and at least one of the at least two assisting lateral wellbores or propped fractures extending therefrom.

Further there is provided a method for improving a flow of a hydrocarbon from at least one primary lateral wellbore in a shale interval in a subterranean formation, where the method includes, from the primary lateral wellbore, drilling a plurality of kick-off wellbores in the shale interval away from the at least one primary lateral wellbore, each of the kick-off wellbores being located in a respective fracturing stage interval, where at least two of the kick-off wellbores are not parallel relative to each other; hydraulically fracturing the shale interval from each kick-off wellbore to create a respective primary fracture network in each respective fracturing stage interval; intend to cross the select reservoir to be stimulated; and/or to intersect at least one sweet-spot horizon (i.e. the horizon with in the shale interval to be hydraulically fractured that will produce the most hydrocarbon compared to the shale horizons hydraulically fractured directly above and below) in the shale interval vertically by the cross-interval landing of at least one kick-off wellbore; and drilling at least one additional kickoff wellbore into the at least one sweet-spot horizon and hydraulically fracturing the shale interval from the at least one additional kick-off wellbore horizon to create an additional respective primary fracture network in an additional fracturing stage interval.

DETAILED DESCRIPTION

Figure 1:
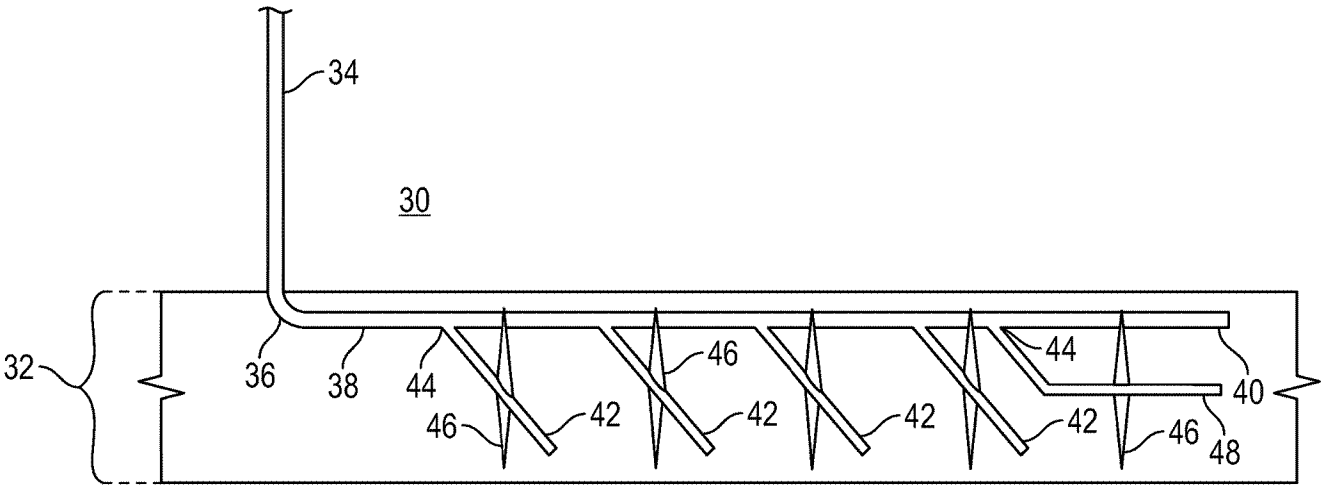
FIG. 1 is a cross-sectional profile view of a shale interval in a subterranean formation illustrating kick-off wellbores along a primary lateral wellbore.

Recovering hydrocarbons from subterranean formations using a single wellbore or "mono-bore" approach, even implementing directional drilling and hydraulic fracturing, has a number of limitations. First, control of the closure of the fracture, once the hydraulic fracture treatment is completed, can be accompanied by undesirable proppant settling and loss of conductivity common to extensively long fracture closure times. Second, the fracture network must be cleaned up, that is, contaminants, fines, residual gel, large volume of aqueous fluid, and the like need to be removed from the induced fracture network, otherwise there may be impaired production (treatment fluid induced formation damage). Third, over-displacement of the proppant may cause the proppant to be lost, removed, or reduced in concentration per square foot at the perforations, wellbore, and/or near-wellbore regions; that is, there is loss of fracture conductivity at the wellbore perforations and/or immediately connecting lateral wellbore-hydraulic fracture or fractures region.

Many operators slightly overdisplace to try to leave the proppant where it is wanted in the fracture and to avoid leaving proppant material in the wellbore. Intentional overdisplacement may be used, but this tends to reduce fracture conductivity at the perforations and/or immediate wellbore region (i.e. propped fracture width of the fractures adjoining the lateral wellbore), lowering the overall success of the reservoir fracture stimulation due to a wellbore choke effect (i.e. flow restriction or reduction).

Additionally, there are limitations in current technology including, but not necessarily limited to, accuracy in targeting and fracturing sweet-spot horizons (defined herein as the strata within a shale interval that represents the best production or potential production of hydrocarbons), and aggressive proppant schedules, which have wellbore screenout concerns. Screenout is a condition that occurs when solids carried in a treatment fluid, such as proppant in a fracturing fluid, create a bridge across perforations, or another type of restricted flow area. This creates a sudden and significant restriction of fluid flow that causes a rapid increase in pumping pressure. If screenout occurs undesirably early in the treatment, it may indicate an incomplete treatment. Additionally, large amounts of proppant left in the wellbore by an early screenout must be removed prior to the next fracture treatment.

It has been discovered that many of these problems and limitations may be overcome using multiple lateral wellbores—beyond conventional "mono-bore" approaches. The use of multiple lateral wellbores can provide one or more abilities including, but not necessarily limited to, induced fracture closure, fracture network cleanup, optimized production treatments, multi-lateral refracturing ("refrac") treatments, and combinations of these. Improvements may include control of the fracture network closure to resolve proppant suspension problems for improved fracture conductivity distribution and control of the fracture network cleanup, better treatment fluid unloading, better water-block and residual gel removal, and better optimization and maintenance of fracture network production.

In new field evaluations, the use of multiple lateral wellbores can assist in locating economical horizons. In early field learning, these multiple lateral wellbores can help in identifying and landing in sweet-spot horizons, improve the basic frac treatment design, investigate aggressive frac processes, and improve fracture network cleanup and treatment cleanup techniques. In main field completions, the use of multiple lateral wellbores can assist in optimizing frac treatments and cleanup designs. In mid- to late well production, multiple lateral wellbores can help with production fluid mapping, evaluation of production optimization treatments and the applications of treating chemicals. In refracs, the multiple lateral wellbores may assist with the selection of candidate fields, frac intervals, the fracture treatment design and fracture cleanup techniques.

In another non-limiting embodiment, the process of establishing communication between adjacent lateral wellbores may include one or more sub-methods including, but not necessarily limited to, for improving methods to induce fracture network closure, for cleaning up fracture networks, for placing proppant in one or more fracture networks, for treating one or more fracture networks by injecting production chemicals, performing refracs, and the time between drilling primary laterals and assisting laterals can be several years, and after primary laterals or other lateral wellbores have been produced for several years. In other words, acreage and a field of lateral wellbores may already exist where in-field drilling of additional lateral wellbores between or adjacent to existing lateral wellbores may be configured to practice the multi-lateral stimulation and production benefits. In one non-limiting example, the newer lateral wellbores drilled may be labeled as "primary laterals" and the existing or older and already produced lateral wellbores as "assisting laterals". The in-fill new lateral wellbores could then be multi-laterally stimulated with use of the existing production lateral wellbores, where the new lateral wellbore is first near-wellbore fractured followed by then generating a conductive primary fracture into the older laterals' fracture network and/or to or very near the older laterals' wellbores, followed by release of treatment pressure through the older lateral wellbores to induce closure of the new primary lateral fracture network, and then eventually the older lateral wellbores are used to supply energy and mass or cleanup fluid to clean-up the prior and/or the newly created fracture network, where the cleanup fluid and the residual treatment fluid is produced into the new primary lateral wellbore. By "in-fill" is meant a wellbore that is positioned between or more pre-existing wellbores.

The first drilling and producing conventional field lateral wellbores followed by later time in-fill lateral drilling may be advantageous for many reasons to the operator. Factors such as (a) determining hydrocarbon production economics, (b) determining areas of the acreages and shale reservoir which may indicate having higher total hydrocarbon content, (c) lessons learned through different completion parameters (such as interval spacing, perforation spacing and density, and the like), (d) better indication of horizons of the shale interval that are the sweet spots, and the like can play a role in a later in-fill drilling program that utilizes the bi-directional communication of laterals established between old and new lateral wellbores that are stimulated between the multiple lateral wellbores. All laterals, both old and new, can then be producing laterals. There can be a wide range of variables in how the old laterals and perforated intervals are utilized in respect to the newly drilled adjacent laterals.

In another non-limiting example, the older lateral wellbores may be refractured followed by the new primary lateral stimulation process, where the restimulation includes a new in-fill completion process of this art. In yet another non-limiting example, once the new lateral wellbore is stimulated and cleaned up through use of the older adjacent lateral wellbores, the older lateral wellbores can initially or later become the far-field complex fracture network in relation to the new primary lateral wellbore and its production characteristics. The in-fill process may also, in another non-limiting example, provide a wide range of diagnostic information in drilling, stimulating, closing, cleanup and production of the new infill primary lateral wellbores. The diagnostic information may be different or similar as compared to all adjacent lateral wellbores being newly drilled and non-produced prior to stimulation, closure and cleanup process by lateral-to-lateral communication established in multi-lateral completions as described herein. The more complete and more accurate information about processes and events downhole can have considerable economic value in how to better improve stimulation and completions of shale reservoirs in general or in geo-specific areas.

Turning to the Figures, FIG. 1 is a cross-sectional profile view of a shale interval 32 in a subterranean formation 30 illustrating a vertical wellbore 34 that is turned at heel 36 into a primary lateral wellbore 38 extending to toe 40 having five kick-off wellbores 42 and 48 along its length (distance from heel 36 to toe 40). The kick-off wellbores 42 and 48 begin at displacement points 44, and the number of kick-off wellbores 42 shown in FIG. 1 is arbitrary and shown for illustrative purposes only. The number of kick-off wellbores that would be used in an actual design would depend upon a number of factors including, but not necessarily limited to, the length of the primary lateral wellbore 38, the permeability of the shale interval 32, the number of fracture intervals planned for stimulating the entire lateral, and the like. Kick-off wellbore 48 is different from kick-off wellbores 42 that are simply angled away from primary lateral wellbore 38 in that kick-off wellbore 48 is directed to extend substantially parallel to and adjacent primary lateral wellbore 38. Perforations 46, schematically indicated by the triangles, extend from the kick-off wellbores 42 not from the primary lateral wellbore 38, and hydraulic fracturing may be conducted at these perforations 46. In one non-limiting embodiment, kick-off wellbores are drilled at an angle ranging from about 10° to about 90° from the at least one primary lateral wellbore from which they extend.

In the multi-lateral wellbore configuration of FIG. 1, one method for improving a flow of hydrocarbon from primary lateral wellbore 38 in shale interval 32 in a subterranean formation 30 involves drilling at least one kick-off wellbore 42 and/or 48 in the shale interval 32 away from the at least one primary lateral wellbore 38 and then hydraulically fracturing the shale interval 32 from the kick-off wellbores 42 and/or 48. The method further includes simultaneously with or subsequent to the hydraulically fracturing, introducing a proppant-laden fluid (not shown) into the at least one primary lateral wellbore 38 and the at least one kick-off wellbore 42 and/or 48. Subsequent to the introduction of the proppant-laden fluid, a flush fluid is introduced into the at least one primary lateral wellbore 38 and the at least one kick-off wellbore 42 and/or 48 such that overdisplacement of the flush fluid causes the proppant-laden fluid to be placed into the at least one kick-off wellbore 42 and/or 48 preferential to the at least one primary lateral wellbore 38. In this way, tolerance of potential overdisplacement is built into the configuration.

Figure 2A:
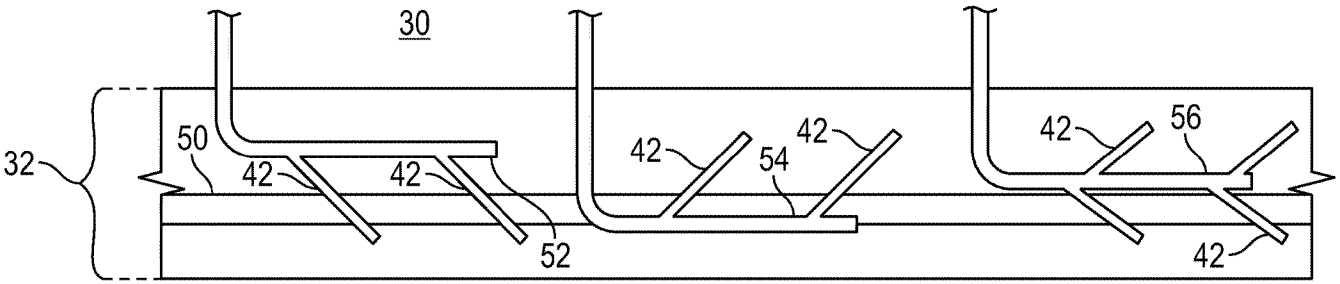
FIG. 2A is a cross-sectional profile view of a subterranean formation with a shale interval having a sweet-spot horizon positioned low illustrating kick-off wellbores along three primary lateral wellbores.

Shown in FIG. 2A is a cross-sectional profile view of a subterranean formation 30 with a shale interval 32 having a sweet-spot horizon 50 positioned low in interval 32 illustrating kick-off wellbores along three primary lateral wellbores 52, 54 and 56, each having multiple kick-off wellbores 42. It will be appreciated that although kick-off wellbores 42 that are simply angled away from the primary lateral wellbores 52, 54 and 56, these kick-off wellbores 42 may be directed to be substantially parallel to primary lateral wellbores 52, 54 and 56 as kick-off wellbore 48 is illustrated in FIG. 1.

Figure 2B:
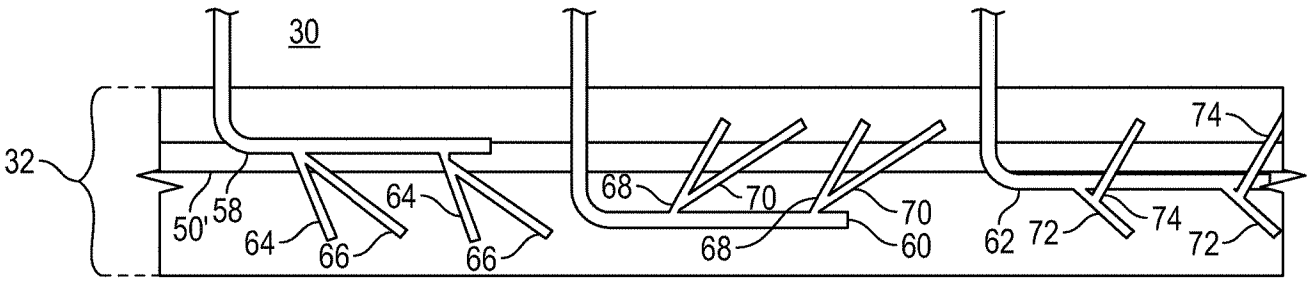
FIG. 2B is a cross-sectional profile view of a subterranean formation with a shale interval having a sweet-spot horizon positioned high illustrating kick-off wellbores along three primary lateral wellbores.

In FIG. 2A, primary lateral wellbore 52 is above sweet-spot horizon 50 and kick-off wellbores 42 angle downward to intersect and/or penetrate into it. Primary lateral wellbore 54 is shown as directly contacting sweet-spot horizon 50, where kick-off wellbores 42 angle upward. Primary lateral wellbore 56 is also above sweet-spot horizon 50 (but in the middle of shale interval 32), although lower than primary lateral wellbore 52, and kick-off wellbores 42 angle both upward and downward to cross and/or penetrate into sweet-spot horizon 50. FIG. 2B is a cross-sectional profile view of a subterranean formation 30 with a shale interval 32 having a sweet-spot horizon 50 positioned higher (relative to that illustrated in FIG. 2A) illustrating kick-off wellbores 42 along three primary lateral wellbores 58, 60 and 62. Primary lateral wellbore 58 directly contacts sweet-spot horizon 50 itself and has kick-off wellbores 64 that in turn have kick-off wellbores 66 extending from kick-off wellbores 64 at different angles than kick-off wellbores 64. Primary lateral wellbore 60 is near the bottom of shale interval 32, and this primary lateral wellbore 60 has kick-off wellbores 68 that in turn have kick-off wellbore 70 extending therefrom at different angles than kick-off wellbores 64, all of which intersect or contact sweet-spot horizon 50. Primary lateral wellbore 62 is near the middle of shale interval 32, and this primary lateral wellbore 62 has kick-off wellbores 72 that angle downward, which in turn have kick-off wellbore 74 extending upward therefrom at different angles than kick-off wellbores 72, the latter of which intersect or contact sweet-spot horizon 50. Thus, the various configurations illustrated in FIGS. 2A and 2B schematically illustrate how kick-off wellbores may extend from primary lateral wellbores to find, contact and produce from the sweet-spot horizons 50 and 50' with more efficiency as compared to a conventional monobore approach.

A method for improving a flow of hydrocarbon from at least one primary lateral wellbore in a subterranean shale formation 30 having at least one shale interval 32 may be accomplished with the configurations shown in FIGS. 2A and 2B, where the method comprises drilling a plurality of kick-off wellbores 42, 64, 66, 68, 70, 72 and/or 74 in the shale interval 32 away from the at least one primary lateral wellbore 52, 54, 56, 58, 60 and/or 62, each of the kick-off wellbores 42, 64, 66, 68, 70, 72 and/or 74, where at least two of the kick-off wellbores 42, 64, 66, 68, 70, 72 and/or 74 are not parallel relative to each other. The shale interval 32 is hydraulically fractured from each kick-off wellbore 42, 64, 66, 68, 70, 72 and/or 74 to create a respective primary fracture network (not shown in FIGS. 2A and 2B). The at least one sweet-spot horizon 50 is identified by a parameter selected from the group consisting of the increased and/or highest total organic content (TOC) strata with in the interval of shale being hydraulically fractured; the sub-interval where the bulk of the hydrocarbon production comes from, that is, the horizon or strata that produces higher total amounts of hydrocarbon over the shortest period of time when hydraulically fractured compared to the strata directly or immediately above and below of the hydraulically fractured shale interval; the interval which has natural fractures that are easiest to hydraulically fracture, dilate, and/or keep wedged and/or propped open; and the three-dimensional (3D) geologic entity (section of reservoir) that is more susceptible to creating complex fracture networks when hydraulically fractured. A sub-interval is defined herein as any smaller division of a larger interval. The method may also include drilling at least one additional kickoff wellbore 42, 64, 66, 68, 70, 72 and/or 74 into the at least one sweet-spot horizon 50 and hydraulically fracturing the shale interval from the at least one additional kick-off wellbore to create an additional respective fracture network 42, 64, 66, 68, 70, 72 and/or 74. The use of the kickoff wellbores should allow for more optimum and direct fracturing of the sweet-spot horizon(s), and the latter stage planar fracture width, length and conductivity generated between the wells may be increased. A goal is to intersect at least one sweet-spot horizon 50 in the shale interval vertically by at least one kick-off wellbore. See the subsequent Figures and the discussion thereof.

Figure 3:
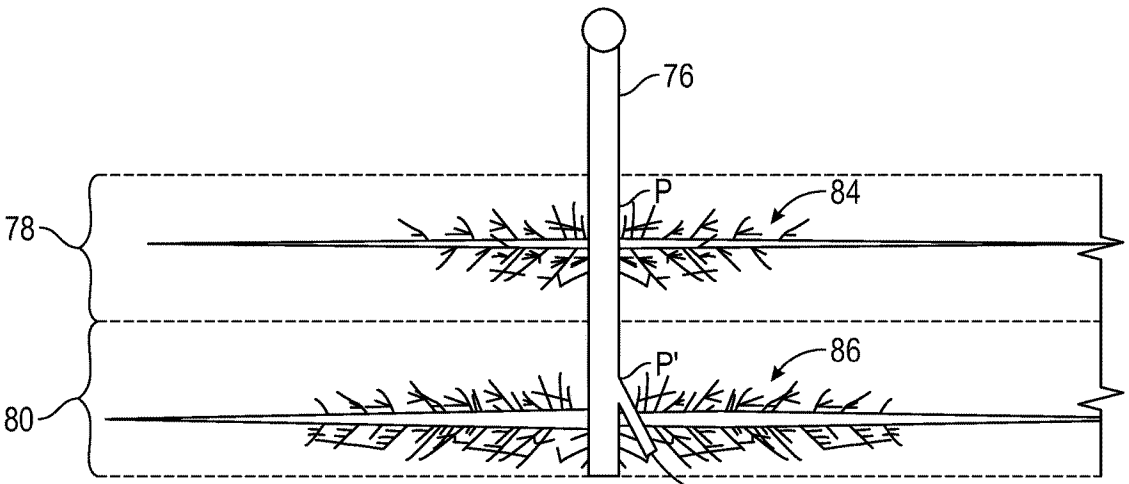
FIG. 3 is top down, plan sectional view of a primary lateral wellbore schematically illustrating a more conservative fracturing and proppant design compared to a portion with a kick-off wellbore schematically illustrating a more aggressive shale fracturing and proppant design.

FIG. 3 is top down, plan sectional view of a primary lateral wellbore 76 having a first fracture interval 78 and a second fracture interval 80. Schematically illustrated in first fracture interval 78 is a more conservative fracture network 84 and proppant design as compared to second fracture interval 80 that schematically illustrating a more aggressive shale fracturing network 86 and proppant design extending from a kick-off wellbore 82. In conventional procedures, the operator wants to flush the proppant-laden treatment fluid beyond point P and into the perforations (i.e. no proppant-laden fluid remains in the wellbore 76), that is beyond the perforations used to create the fracture network 84. The latter design that gives second fracture interval 80 utilizes a "flush to kick-off" (i.e. slightly into kick-off wellbore 82) post flush volume that causes no proppant-laden treatment fluid to remain within wellbore 76, and thus overdisplacement of post flush into the wellbore fractures of 82 is prevented or limited, allowing better fracture network 86 communication and wellbore conductivity to wellbore 76 than the overdisplacement fracturing scenario of zone 78. Typically there are four, six or more stages of a frac treatment, such as the pad stage, the 0.5 ppa (i.e. pounds of proppant added to each one gallon volume of treatment fluid) proppant stage, 1 ppa proppant stage, and the like. The last treatment fluid stage maximizes proppant placement, that is, has the highest loading or concentration of proppant for improved near wellbore fracture conductivity. In the case of hydraulically fracturing interval 80 the post flush may go slightly past point P' and slightly into wellbore 82, and thus proppant-laden slurry will not be left within wellbore 76. This flush, which may be brine (e.g. KCl) or fresh water, pushes the proppant-laden frac fluid out of wellbore 76 like over-displacement of zone 78 but can leave proppant-laden treatment fluid within wellbore 82 and thereby no over-displacement at the fracture wellbore occurs in zone 80. Thus this procedure will not affect the wellbore conductivity in fracture network 86. In short, this new configuration using multiple lateral wellbores permits tolerance of more over-flush, and helps prevent wellbore conductivity loss problems due to overflushing. Thus, with the kick-off wellbore 82, particularly by increasing the length of wellbore 82, over-displacement at the wellbore is eliminated and a more aggressive shale fracturing and proppant design may be employed.

Figure 4:
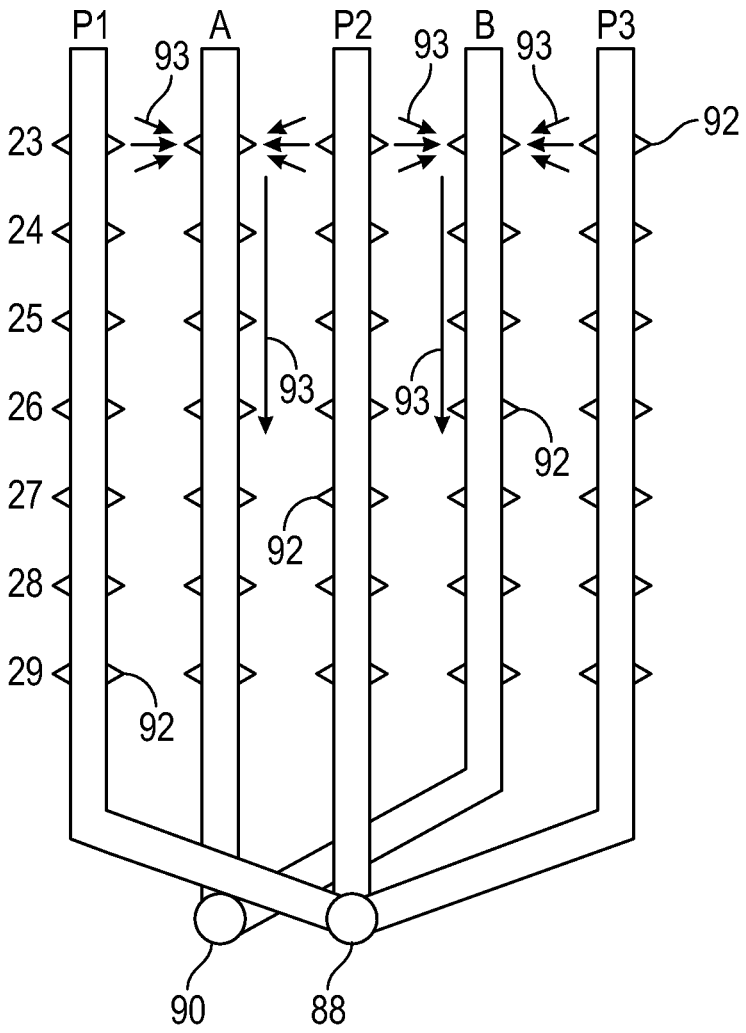
FIG. 4 is a top down, plan sectional view of a configuration of a primary well having three primary lateral wellbores interdigitated with two assisting lateral wellbores schematically illustrating inducing fracture closure.

FIG. 4 is a top down, plan sectional view of a configuration of a primary well 88 having three primary lateral wellbores P1, P2 and P3 interdigitated with two assisting lateral wellbores A and B from assisting well 90 schematically illustrating inducing fracture closure. The fracture intervals are numbered 23, 24, 25, 26, 27, 28 and 29. The fracture intervals 23 through 29 are representative of the illustrated last fracture intervals of the laterals from a total of 1 through 29 fracture intervals, with fracture interval 1 being at the toe location (not shown) of the laterals (29 fracture zones per lateral in the completion design). Perforations 92 are schematically illustrated. Similar reference numerals are used in subsequent Figures for the same or equivalent features. The method generally includes hydraulically fracturing interval 23 from the perforations 92 shown in the three primary lateral wellbores P1, P2 and P3 across from the perforations of two assisting lateral wellbores A and B so that the fracture networks extending from P1 toward the wellbore A connect with the fracture networks extending from A in the opposite direction so that there may be fluid communication between the two networks. Similarly, a fracture network extending from primary lateral wellbore P2 extends to assisting lateral wellbore A and connects therewith so that they are in fluid communication. A fracture network extending from primary lateral wellbore P2 in the other direction (to the right in FIG. 4) connects with a fracture network extending from assisting lateral wellbore B coming the other, opposite direction to connect with and be in fluid communication therewith. Similarly, a fracture network extending from assisting lateral wellbore B toward primary lateral wellbore P3 encounters and connects with a fracture network extending from primary lateral wellbore P3 to be in fluid communication therewith. This interconnecting of fracture networks between primary lateral wellbores and parallel adjacent assisting lateral wellbores occurs often in the methods and configurations described herein and will not always be described in this much detail, or fully illustrated with connecting fracture networks in the drawings, but should be understood to be present when the context so indicates.

In non-limiting embodiments, when at least one assisting lateral wellbore is substantially adjacent to the primary lateral wellbore, this may be defined as within about 50 independently to about 1200 feet (about 15 independently to about 366 meters) of each other, alternatively within about 100 independently to about 800 feet (about 30 independently to about 244 meters) of each other. "Substantially parallel" is defined herein as within 0 independently to about 8° of the same angle as each other; alternatively within from about 0° independently to about 5° of each other. The term "independently" as used herein with respect to a range means that any lower threshold may be combined with any upper threshold to give a suitable alternative range.

Returning to the discussion of the method, the objective for generating the fracture networks is to connect them by hydraulic fracturing through the perforations in interdigitated lateral wellbores P1, A, P2, B and P3 and the proppant squeezed into place in fracture networks created between the wells, the treatment pressure is removed after each multi-lateral fracture treatment to timely induce fracture network closure by allowing flow and/or withdrawing fluid from the fracture networks in the directions of the arrows 93 in FIG. 4 via assisting lateral wellbores A and B. For the fracture networks around primary lateral wellbore P2, the fracture treatment pressure is removed in two directions. This inducement of closure of the fracture network after each multi-lateral fracture treatment more assuredly places and retains the proppant in the correct places (i.e. vertical distribution in fractures) to provide enhanced vertical conductivity while inhibiting or preventing the proppant from settling in undesirable locations, such as at the bottom of the hydraulic fractures due to extended closure times typical of shale fracturing; that is, fracture closure locks the proppant in place). In one non-limiting example, hydraulic fractures can be performed in three wells (i.e. multi-lateral fracturing) in various sequences, such as in lateral wellbore A in interval 23 and in wellbore B in interval 23, where planar and complex fractures are created from and around wellbores A and B in interval 23, then a hydraulic fracture is created in wellbore P2 with the later stages of the treatment emphasized to generate a propped conductive channel from wellbore P2 to either wellbore A or wellbore B or both, and then upon completing treatment fluid displacement in wellbore P2, closure is induced by flowing reservoir treatment pressure into wellbore A or wellbore B or in a non-limiting suitable embodiment both wellbores A and B to lock suspended proppant in place. Other treatments and closures on other sections of the laterals can be performed, such as hydraulic fracturing wellbore P1 at interval 23 and upon treatment completion release of reservoir treatment pressure into wellbore A at interval 23 to induce closure of stimulated wellbore P1 at interval 23.

Figure 5:
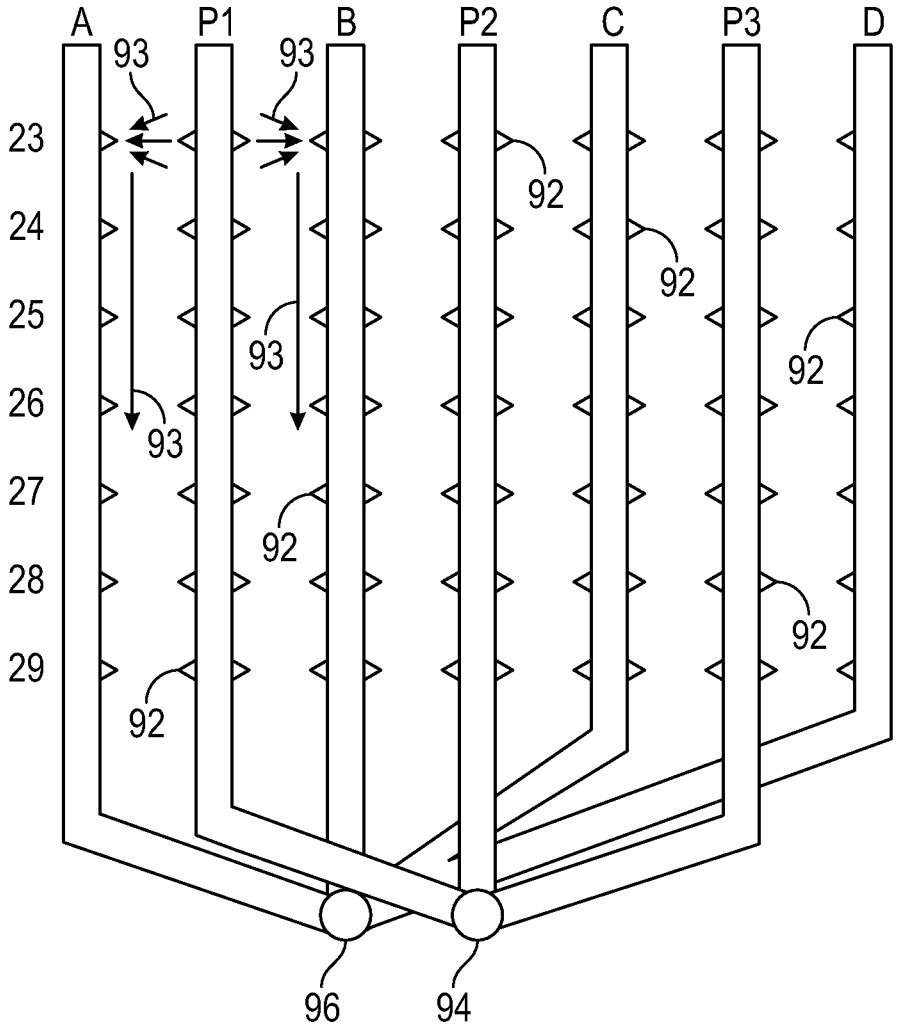
FIG. 5 is a top down, plan sectional view of an alternative configuration of a primary well having three primary lateral wellbores interdigitated with four assisting lateral wellbores from a single well schematically illustrating inducing fracture closure.

FIG. 5 is a top down, plan sectional view of an alternative configuration from that of FIG. 4 of a primary well 94 having three primary lateral wellbores P1, P2 and P3 interdigitated with four assisting lateral wellbores A, B, C and D extending from single assisting well 96 schematically illustrating inducing fracture closure. Similarly to FIG. 4, after the fracture networks are connected by hydraulic fracturing through the perforations in interdigitated lateral wellbores A, P1, B, P2, C, P3 and D and the proppant squeezed into place, the pressure is removed to induce fracture network closure by allowing flow and/or withdrawing fluid from the fracture networks in the directions of the arrows 93 in FIG. 5 via assisting lateral wellbores A, B, C and D. For the fracture networks around primary lateral wellbore P1, P2 and P3, the pressure is removed in two directions. This inducement of closure of the fracture network more assuredly places the proppant in the correct places to provide enhanced conductivity while inhibiting or preventing the proppant from settling in undesirable locations.

Figure 6:
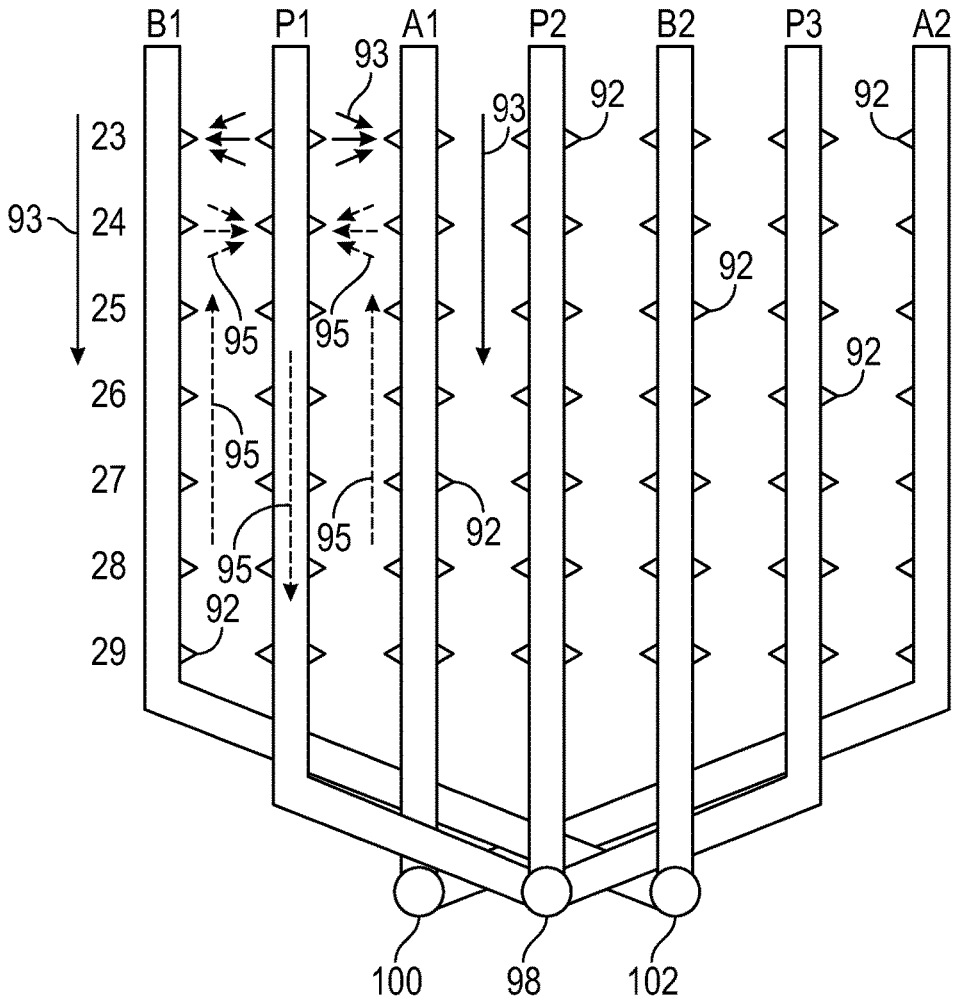
FIG. 6 is a top down, plan sectional view of an alternative configuration of a primary well having three primary lateral wellbores interdigitated with four assisting lateral wellbores from two assisting wells schematically illustrating inducing fracture closure and fracture network cleanup.

FIG. 6 is a top down, plan sectional view of the alternative configuration of a primary well 98 having three primary lateral wellbores P1, P2 and P3 interdigitated with four assisting lateral wellbores B1, A1, B2 and A2 from two assisting wells, 100 (A) and 102 (B) (two each) schematically illustrating inducing fracture closure after each concerted multi-lateral hydraulic fracture treatment, as in FIGS. 4 and 5 with reference to the solid arrows 93. Also schematically illustrated in FIG. 6 is a multi-lateral fracture network cleanup procedure as illustrated by the dashed arrows 95. In the fracture network cleanup procedure flow is reversed, the cleanup fluid, such as water or brine, or an inert gas (e.g. $N_2$ or $CO_2$) or other treatment fluid with cleanup agents, is injected in a concerted order and time through four assisting lateral wellbores B1, A1, B2 and A2, across the interconnected fracture networks, and removed by primary lateral wellbores P1, P2 and P3. Conventional diversion techniques may also be used to expand and/or direct treatments, such as acidizing treatment; for instance by using crosslinked or uncrosslinked polymers and/or aqueous fluids viscosified with VES to divert acid. All of these wells 98, 100 and 102 and wellbores P1, P2, P3, A1, A2, B1 and B2 may eventually be producing wells once completion is accomplished.

Figure 7:
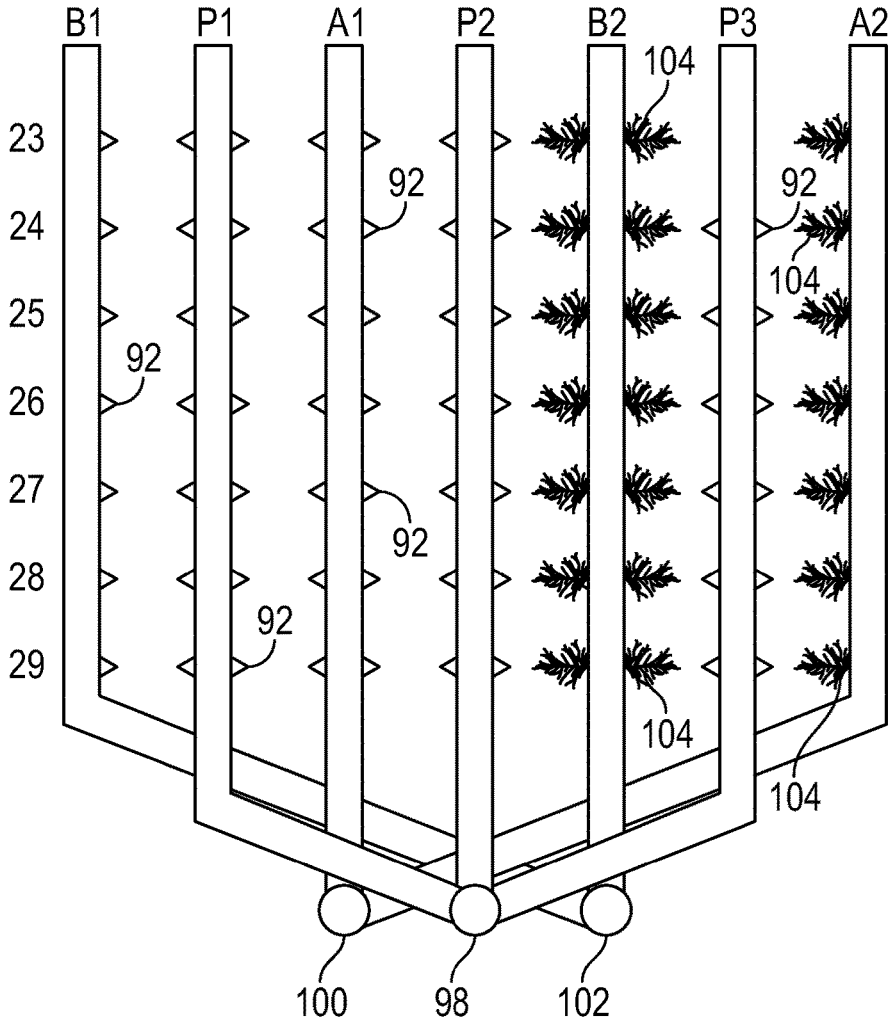
FIG. 7 is a top down, plan sectional view of an alternative configuration of a primary well having three primary lateral wellbores interdigitated with four assisting lateral wellbores, two each from two assisting wells such as that in FIG. 6, schematically illustrating the creation of fracture network complexity in opposing assisting lateral wellbores.

Beginning with FIG. 7, a stimulation using multiple primary lateral wellbores and assisting lateral wellbores is described from a top down, plan sectional view of an alternative configuration of a primary well 104 having three primary lateral wellbores P1, P2 and P3 interdigitated with four assisting lateral wellbores B1, A1, B2 and A2, two each from two assisting wells 100 and 102 as shown in FIG. 6, schematically illustrating the creation of fracture network complexity in opposing assisting lateral wellbores. Shown in FIG. 7 are complex fracture networks 104 created by hydraulic fracturing adjacent the perforations for fracture intervals 23-29 for opposing assisting lateral wellbores B2 and A2. The treatment pressure is retained and then released from the formation after each interval is fractured to provide closure before fracturing the next interval; for instance inducing closure in interval 23 before fracturing interval 24, inducing closure in interval 24 before fracturing interval 25, etc.

Figure 8:
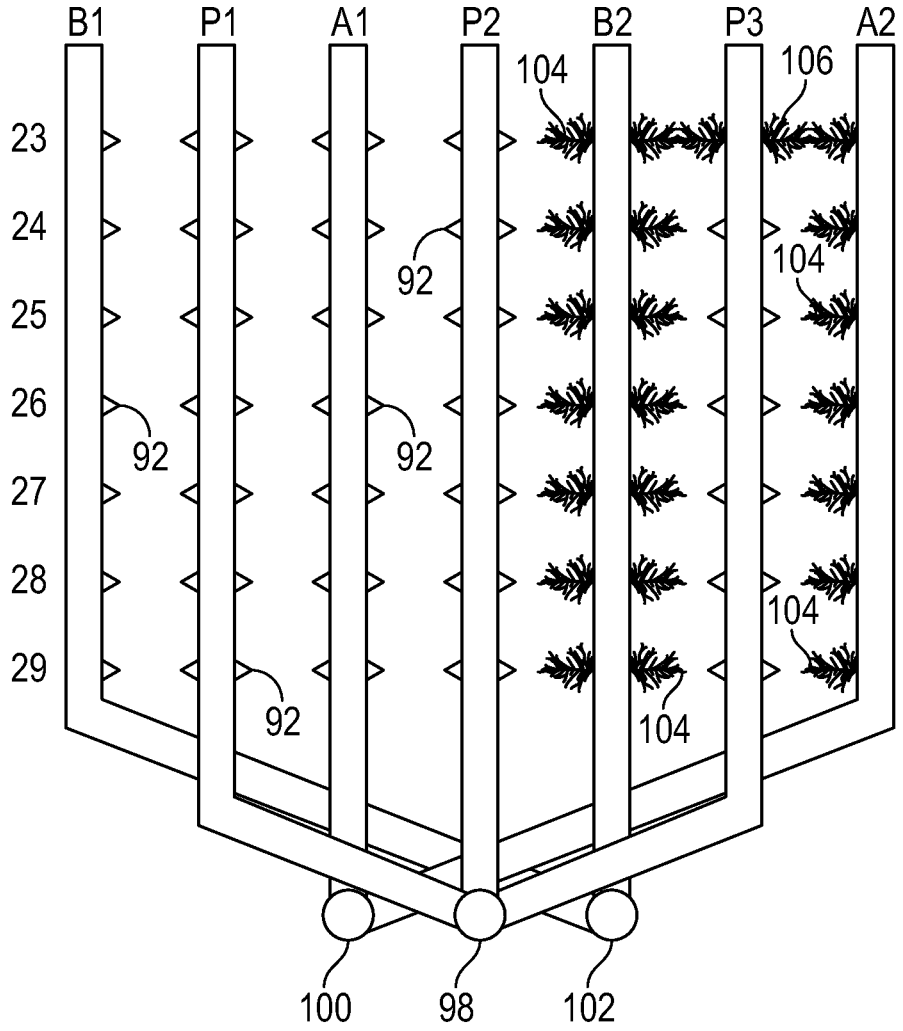
FIG. 8 is a top down, plan sectional view of the alternative configuration of lateral wellbores of FIG. 7 further schematically illustrating the creation of a near-wellbore fracture network complexity in the primary lateral wellbore between opposing assisting lateral wellbores.

The results of creating near-wellbore complex fracture network 106 in primary lateral wellbore P3 within frac interval 23 is shown in FIG. 8.

Figure 9:
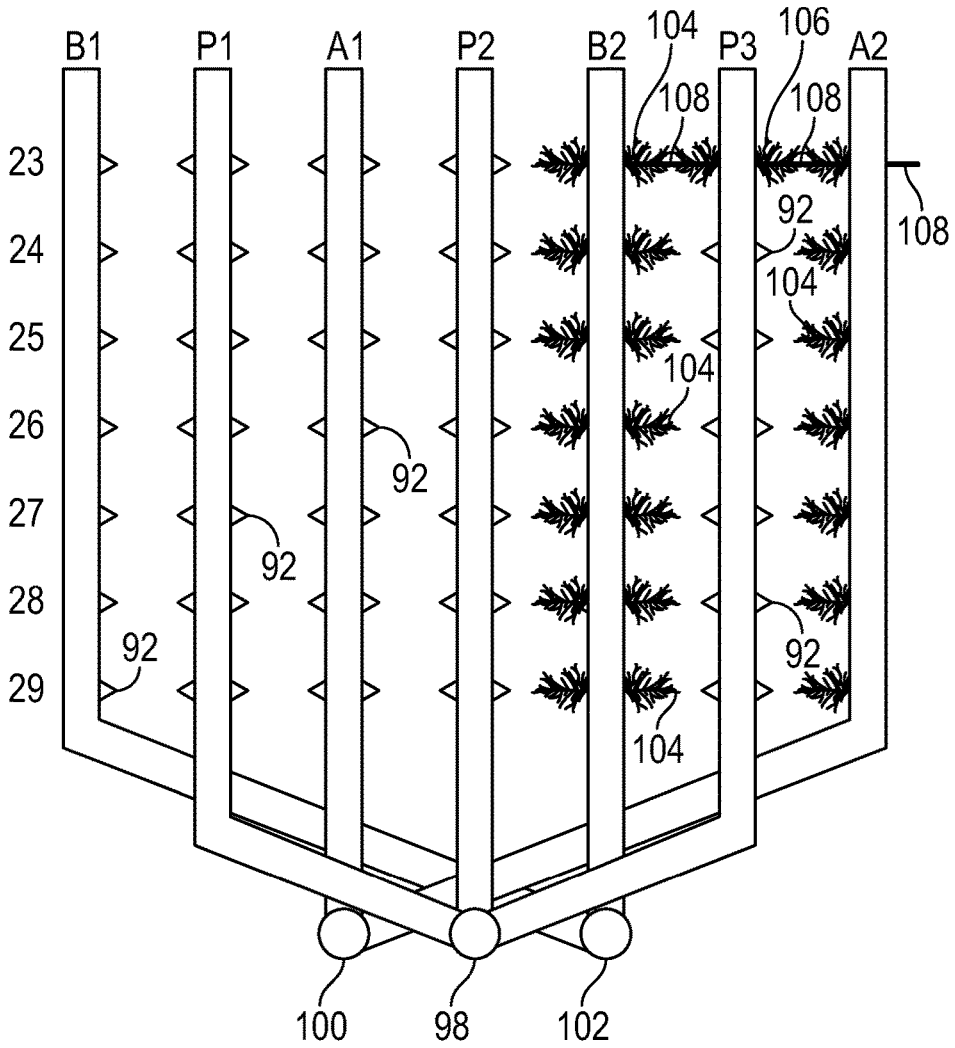
FIG. 9 is a top down, plan sectional view of the alternative configuration of lateral wellbores of FIG. 8 further schematically illustrating the creation of a conductive primary fracture from the primary lateral wellbore into the fracture network complexity of the opposing assisting lateral wellbores.

Creating conductive primary fracture 108 from primary lateral wellbore P3 into the complex fracture networks 104 of adjacent assisting lateral wellbores B2 and A2 gives the structure shown in FIG. 9. This may be done by hydraulic fracturing from perforations 92 in interval 23 of primary lateral wellbore P3 in the direction of assisting lateral wellbores B2 and A2 so that primary lateral wellbore P3 is in fluid communication with assisting lateral wellbores B2 and A2 through complex fracture networks 104 and 106 and conductive primary fracture 108.

Figure 10:
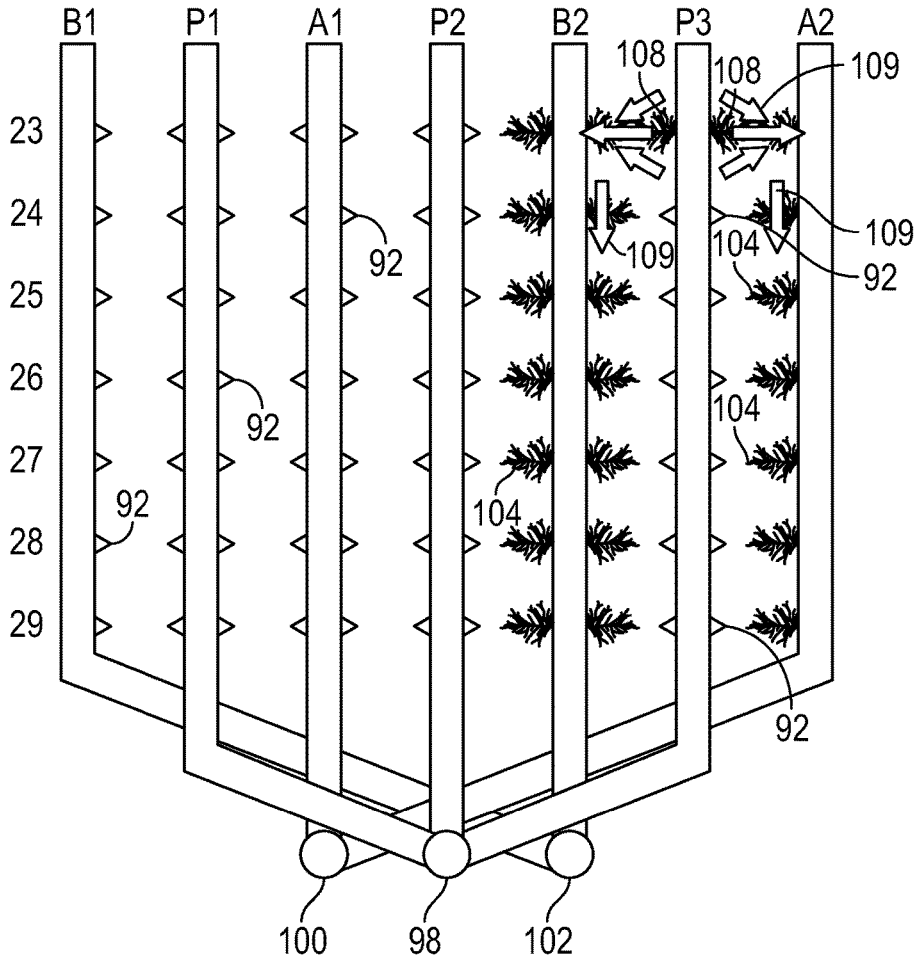
FIG. 10 is a top down, plan sectional view of the alternative configuration of lateral wellbores of FIG. 9 schematically illustrating the release of treatment pressure to induce closure within the primary fracture and the complex fracture network.

Treatment pressure is then released to induce closure within conductive primary fracture 108 and complex fracture networks 104 by removing fluid in the direction of the white arrows 109, as shown in FIG. 10.

Figure 11:
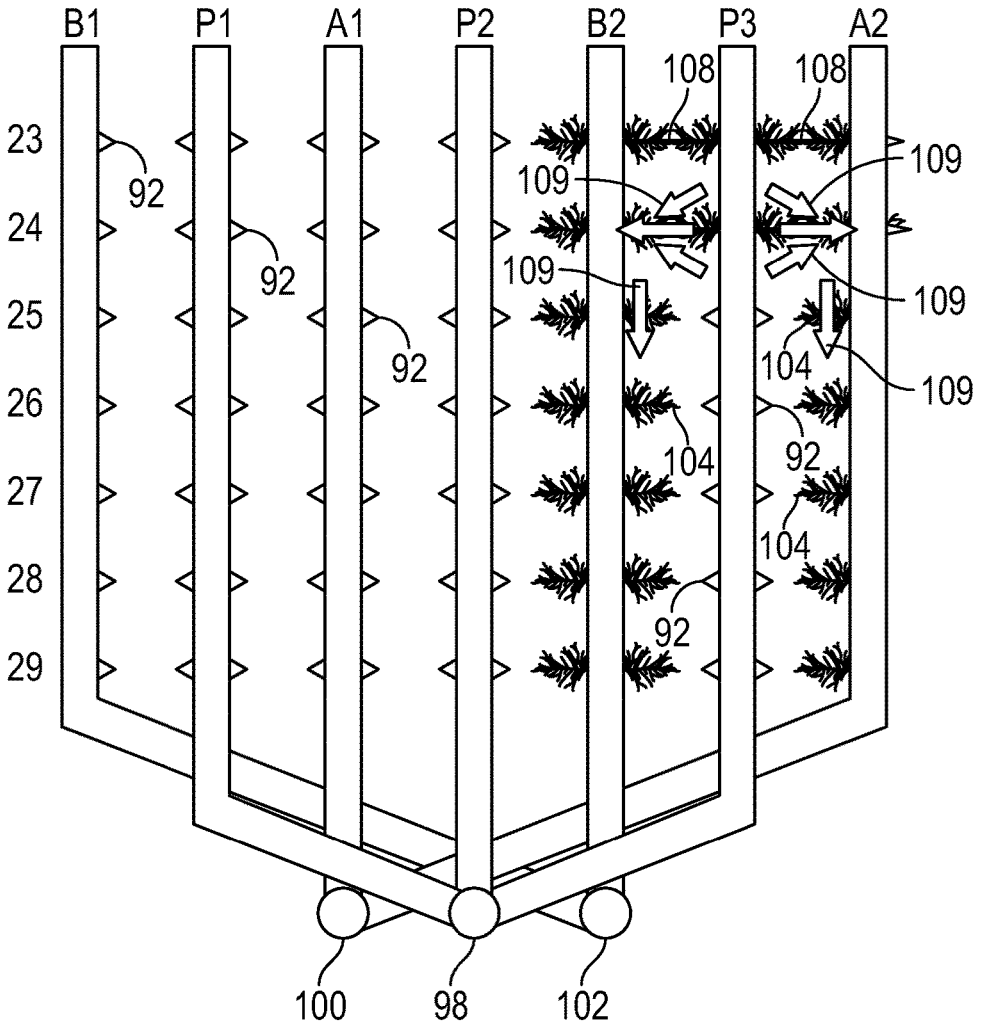
FIG. 11 is a top down, plan sectional view of the alternative configuration of lateral wellbores of FIG. 10 schematically illustrating the repetition of the previous steps for the next fracture interval.

As shown in FIG. 11, the above-described steps are repeated for next frac interval 24 for primary lateral wellbore P3 and adjacent assisting lateral wellbores B2 and A2. In one non-limiting embodiment, FIGS. 7 through 12 illustrate one example of multi-lateral hydraulic fracturing, the process of fracturing wellbore laterals B2, P3, and A2 in fracture intervals 23 through 29. Many other options and sequences of performing fracturing of fracture interval 23 through 29 for wellbore laterals B2, P3, and A2 can be arranged and performed.

Figure 12:
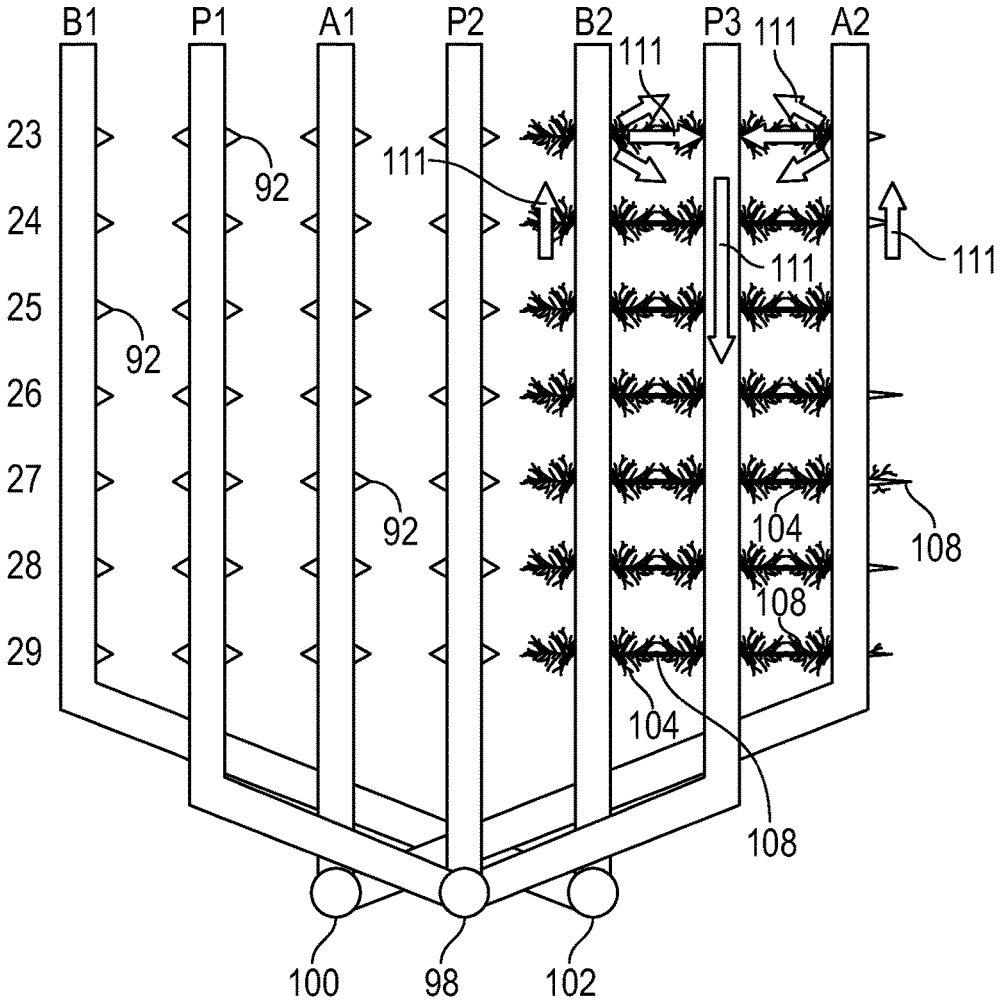
FIG. 12 is a top down, plan sectional view of the alternative configuration of lateral wellbores of FIG. 11 schematically illustrating cleaning up the primary fracture and the complex fracture network of each frac interval one frac interval at a time.

Shown in FIG. 12 is a top down, plan sectional view of the alternative configuration of lateral wellbores of previous Figures, such as FIG. 11, schematically illustrating that all of the frac intervals 23-29 have had conductive primary fracture 108 implemented connecting complex fracture networks 104 between primary lateral wellbore P3 and adjacent assisting lateral wellbores A2 and B2 for each interval. Also shown is the cleaning up the primary fracture 108 and the complex fracture networks 104 of each frac interval 23-29, accomplished one frac interval, 23, 24, 25, 26, 27, 28 and 29 at a time. The directions of the white arrows 111 show the direction of the cleanup fluid, such as inert gases $N_2$ or $CO_2$.

Figure 13:
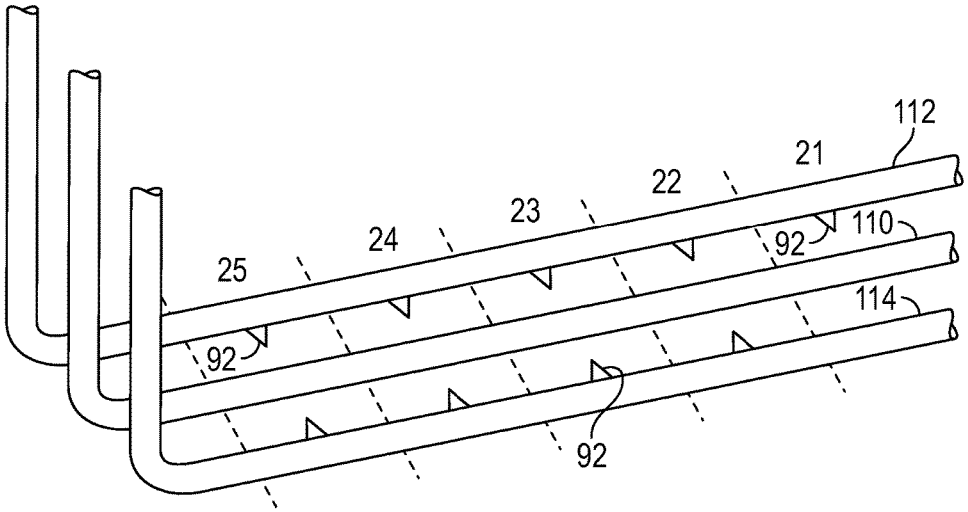
FIG. 13 is a sectional, perspective view of a primary lateral wellbore having two assisting lateral wellbores, one on either side of the primary lateral wellbore substantially adjacent thereto and substantially parallel thereto.

FIG. 13 presents a sectional, perspective view of a primary lateral wellbore 110 having two assisting lateral wellbores 112 and 114, one on either side of the primary lateral wellbore 110 substantially adjacent thereto and substantially parallel thereto. Frac intervals 21, 22, 23, 24 and 25 are shown, along with fracture interval injection and pressure release ports or perforations 92. It will be understood that in embodiments such as those shown in FIGS. 13-26 illustrating multiple frac intervals that these intervals may also be understood as first shale interval 21, second shale interval 22, third shale interval 23, etc.

Figure 14:
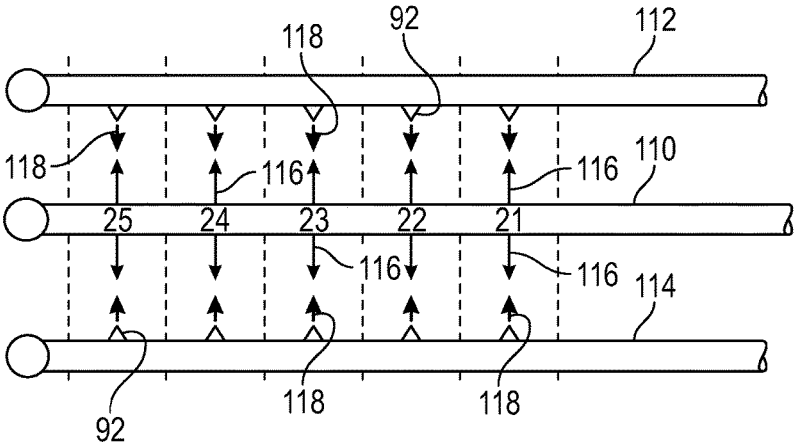
FIG. 14 is a top down, plan sectional view of the primary lateral wellbore having two assisting lateral wellbores, one on either side of the primary lateral wellbore substantially adjacent thereto and substantially parallel thereto of FIG. 13 schematically illustrating fracturing fluid injection from both the primary lateral wellbore and the parallel assisting lateral wellbores.

FIG. 14 is a top down, plan sectional view of the primary lateral wellbore 110 having two assisting lateral wellbores 112 and 114, one on either side of the primary lateral wellbore substantially adjacent thereto and substantially parallel thereto of FIG. 13. FIG. 14 schematically illustrates fracturing fluid injection from both the primary lateral wellbore 110 (arrows 116) and the parallel assisting lateral wellbores (arrows 118). FIG. 14 demonstrates a multi-lateral bi-directional fracturing treatment. The process is flexible. Fracturing may be initiated with the two assisting lateral wellbores 112 and 114 to build a "stress shadow", a region or area on either side of the primary lateral wellbore 110 by pressure injection. This stresses the rock in a lateral direction to provide more control in fracturing the shale. This bi-direction fracturing treatment provides a number of options, in one non-limiting embodiment, the fracturing from the primary lateral wellbore 110 (arrows 116) may be initiated first and then stopped, followed by pumping from the parallel assisting lateral wellbores (arrows 118), in one or more cycles, rather than simultaneously. In one non-limiting embodiment this kind of stop/start-low viscosity/high viscosity staged diversion process may be used to create complex fractures. That is, pumping a relatively low viscosity fracturing fluid, stopping the pressure, then pumping a relatively high viscosity fracturing fluid may be used alternatingly or in cycles to create complex fracture networks. By "fracture networks" or "complex fracture networks" is meant that a series and/or distribution of multiple fractures are generated hydraulically that provide fluid flow pathways and communication through the ultra-low permeability shale reservoir to the wellbore or wellbores, in contrast to simply forming a single and/or a few fractures within the shale reservoir that connect to the wellbore. It is much more desirable to create fracture complexity both in the near-wellbore region and far-field regions than to have a single or a few large fractures. The more surface area of the shale reservoir that is exposed and connected to a wellbore or wellbores (i.e. complex fracture network) through hydraulic fracturing the better, that is, close to the wellbore (near wellbore complex fractures) and/or far from the wellbore (far-field complex fractures). In most cases, when hydraulically fracturing, far-field complex fracture networks are more difficult to create, and as compared to near wellbore complex fracture, typically have reduced number of fractures, surface area, and less flow path systems in further relation to the wellbore.

It may also be understood that there may be more than one perforation or fracture interval injection and pressure release port 92 in the primary lateral wellbore 110 and/or the two assisting lateral wellbores 112 and 114 per interval 21-25. Conventional and new techniques to divert pressure and flow may be used, to change reservoir stress shadows, take advantage of rock and tectonic cleavages, and direct the number of fractures, the locations of fractures and their geometric domain, such as by using diverting agents including, but not necessarily limited to, polymer gels and VES gels. There are also opportunities to change injection rates, pump rates, fluid viscosities, introduce material diverters, vary the proppant types and concentrations, and combinations of these parameters. A goal is to not interfere with eventual production from the primary lateral wellbore 110 although optionally using the two assisting lateral wellbores 112 and 114 for production also is contemplated, and in another non-limiting embodiment is intended and suitable.

Figure 15:
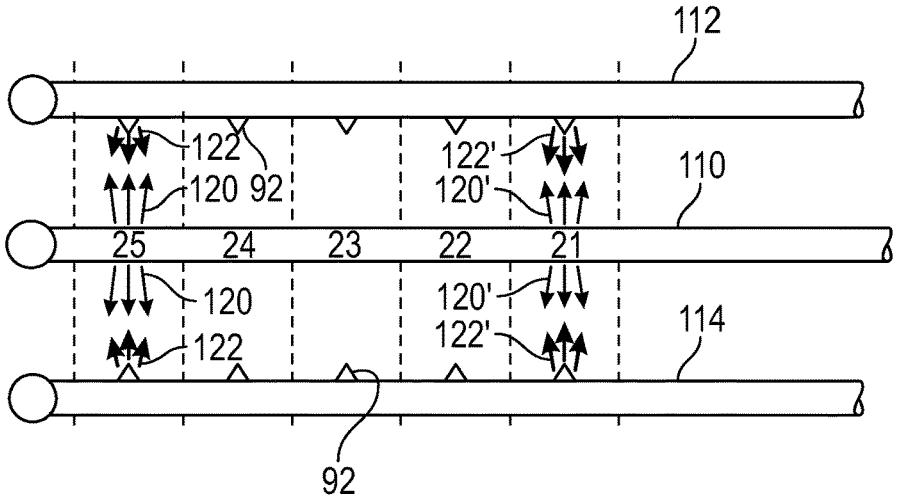
FIG. 15 is a top down, plan sectional view of the primary lateral wellbore having two assisting lateral wellbores, one on either side of the primary lateral wellbore substantially adjacent thereto and substantially parallel thereto of FIG. 14 schematically illustrating differences in fracturing fluid injection (rate, pressure and/or viscosity) from the primary lateral wellbore and the parallel assisting lateral wellbores.

FIG. 15 is a top down, plan sectional view of the primary lateral wellbore 110 having two assisting lateral wellbores 112 and 114, one on either side of the primary lateral wellbore 110 substantially adjacent thereto and substantially parallel thereto of FIG. 14 which schematically illustrates differences in fracturing fluid injection (rate, pressure and/or viscosity) from the primary lateral wellbore 110 by arrows 120 and from the parallel assisting lateral wellbores 112 and 114 by arrows 122. As shown for frac interval 25, the fracturing flow from primary lateral wellbore 110 has a higher rate, higher injection pressure and/or uses higher viscosity as indicated by the longer arrows 120 as compared with the smaller, darker arrows 122. This will accomplish more far-field pressure diversion and network complexity, where "far-field" is defined as away from primary lateral wellbore 110.

As defined herein, in one non-limiting embodiment, "near-wellbore" is within 20 feet (6 m) of the wellbore, alternatively within 60 feet (18 m) of the wellbore. In one non-limiting embodiment, "far-field" is defined as greater than 60 feet (15 m) or from the wellbore; alternatively as 100 feet (30 m) or greater from the wellbore. Alternatively, far-field may also be understood to include midway between the primary lateral wellbore 110 and each of the two assisting lateral wellbores 112 and 114.

Looking at frac interval 21, the arrows 120' are only slightly longer than arrows 122' indicating that the frac fluid flow from primary lateral wellbore 110 has a slightly higher rate, injection pressure and/or viscosity which will accomplish more overall network complexity (both near-wellbore and far-field).

Figure 16:
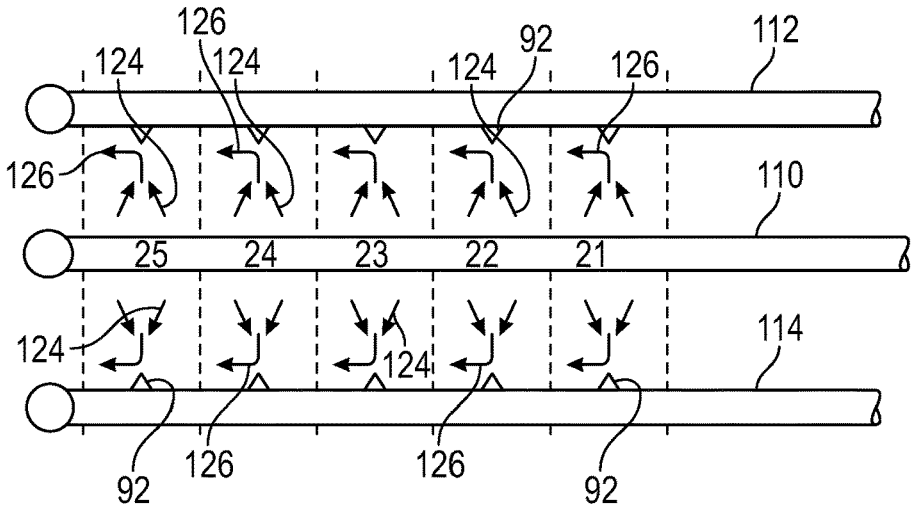
FIG. 16 is a top down, plan sectional view of the primary lateral wellbore having two assisting lateral wellbores, one on either side of the primary lateral wellbore substantially adjacent thereto and substantially parallel thereto of FIG. 14 schematically illustrating that during closure the treatment fluid flows into the parallel assisting lateral wellbores from the fracture networks.
Figure 17:
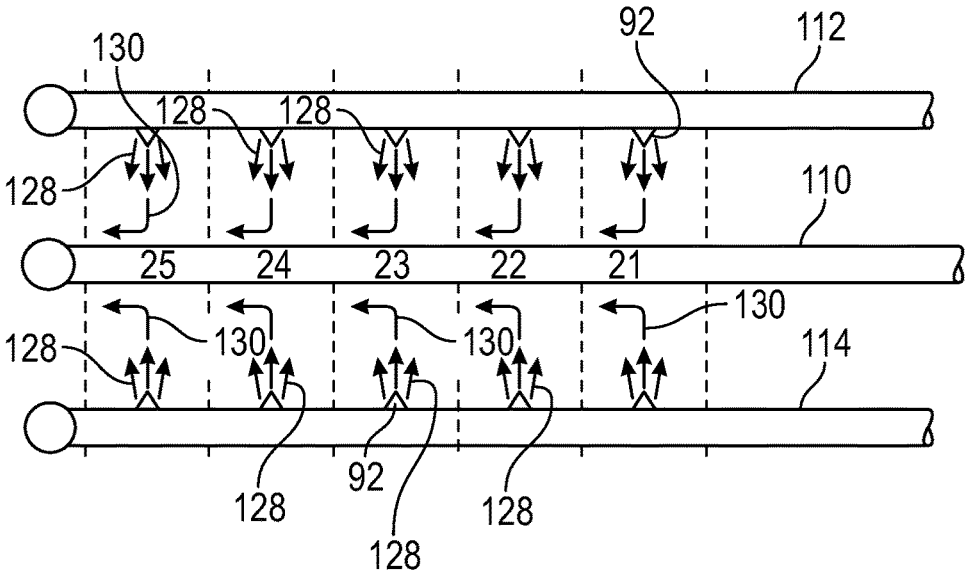
FIG. 17 is a top down, plan sectional view of the primary lateral wellbore having two assisting lateral wellbores, one on either side of the primary lateral wellbore substantially adjacent thereto and substantially parallel thereto of FIG. 14 schematically illustrating that during fracture network cleanup fluid is injected from the parallel assisting lateral wellbores into the primary lateral wellbore through the fracture networks.

Shown in FIG. 16 is another top down, plan sectional view of the primary lateral wellbore 110 having two assisting lateral wellbores 112 and 114, one on either side of the primary lateral wellbore 110 substantially adjacent thereto and substantially parallel thereto as in FIG. 14. FIG. 16 schematically illustrates that during closure of the fracture around primary lateral wellbore 110 the treatment fluid flows into the parallel assisting lateral wellbores 112 and 114 from the fracture networks, as indicated by arrows 124 and 126. That is, parallel assisting lateral wellbores 112 and 114 allow treatment pressure removal and withdrawing or flow of frac fluid and/or other treatment fluid from the fracture network created through fracture interval injection and pressure release ports 92, particularly from around primary lateral wellbore 110. This releases the pressure and induces hydraulic fracture closure, permitting the fractured rock to close upon and by compression lock the proppant in place and thus placing the proppant more uniformly vertically within the fracture network. In other words, the proppant is not given a chance to settle extensively or undesirably by the ability to induce closure and thereby control fracture closure time.

Shown in FIG. 17 again is the primary lateral wellbore 110 having two assisting lateral wellbores 112 and 114, one on either side of the primary lateral wellbore 110 substantially adjacent thereto and substantially parallel thereto as illustrated previously in FIGS. 14-16. However, here fluid is injected for uniquely supplying energy and materials to improve the fracture network cleanup process, particularly compared to conventional mono-wellbore cleanup after stimulation treatments. Arrows 128 indicate the introduction or injection of a cleanup formulated treatment fluid through assisting lateral wellbores 112 and 114 and fracture interval injection and pressure release ports 92 into the far-field area between the lateral wellbores and into primary lateral wellbore 110 as indicated by arrows 130 where the treatment fluid is withdrawn. As noted, this fracture network cleanup involves fluid injection from the parallel lateral assisting wellbores 112 and 114 in a flexible way, and optimized distribution techniques of diversion may be utilized. Further, field trials may be improved for the geo-specific shales and types of fracture networks generated by the hydraulic fracturing process. The cleanup fluid may be any suitable treatment fluid, such as an inert gas, e.g. nitrogen ($N_2$) or carbon dioxide ($CO_2$), light brines like 2% KCl, other types aqueous fluids containing formation and/or fracture cleanup chemicals, such as but not necessarily limited to: clay inhibitors, KCl substitutes, at least one tracer, clay control agents, corrosion inhibitors, iron control agents, mutual solvents, water wetting surfactants, foaming agents, microemulsion cleanup agents, alkyl silanes and/or other hydrophobic inducing agents to plate on the walls of the fracture and/or on the proppants, biocides, polymer breakers, tracers or tracing agents, non-emulsifiers, reducing agents, chelants such as aminocarboxylic acids and salts thereof, organic acids, esters, resins, mineral acids, viscoelastic surfactants, internal breakers for VES fluids such as mineral oils and/or natural plant and fish oils high in unsaturated fatty acids, polymeric-based friction reducers, inorganic nanoparticles, organic nanoparticles, salts, organic scale inhibitors, inorganic scale inhibitors, slow release scale inhibitor agents like ScaleSORB™ available from Baker Hughes, pH buffers, and the like and combinations thereof.

Figure 18:
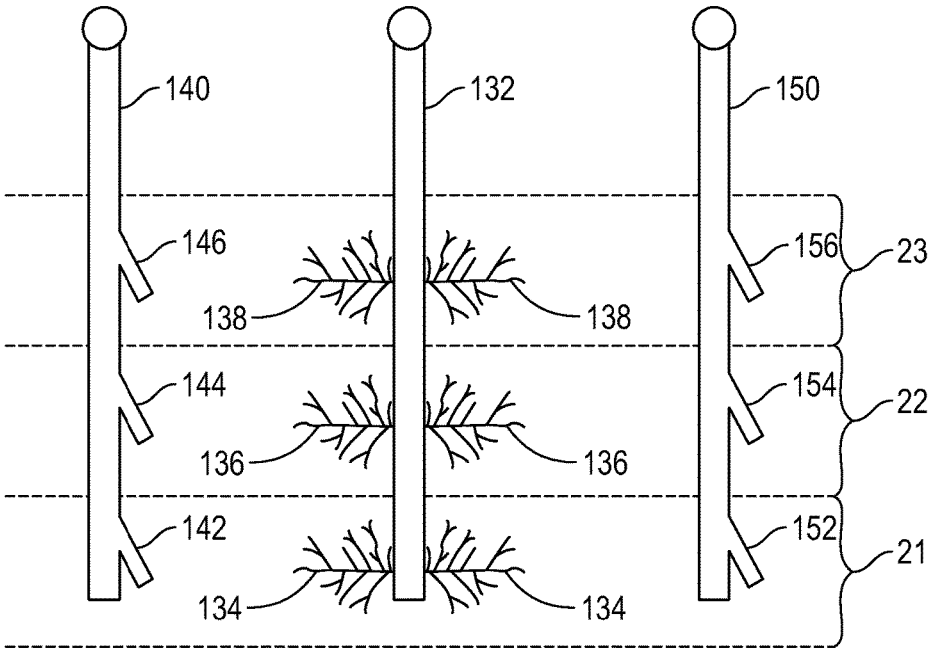
FIG. 18 is a top down, plan sectional view of a configuration of a primary lateral wellbore having two assisting lateral wellbores, one on either side of the primary lateral wellbore substantially adjacent thereto and substantially parallel thereto, where each of the assisting lateral wellbores has three kick-off wellbores, schematically illustrating complex fractures created from the primary lateral wellbore for each of three fracture intervals.

FIGS. 18-21 illustrate an example of kick-off wellbores for multi-lateral stimulation. FIG. 18 is a top down, plan sectional view of a configuration of a primary lateral wellbore 132 having two parallel assisting lateral wellbores 140 and 150, one on either side of the primary lateral wellbore 132 substantially adjacent thereto and substantially parallel thereto, where each of the assisting lateral wellbores 140 and 150 has three kick-off wellbores 142, 144 and 146 and 152, 154 and 156, respectively, extending from the assisting lateral wellbores 140 and 150, the drilling of which is Step One. It will be appreciated that it is not necessary to have two parallel assisting lateral wellbores—one may be sufficient. Alternatively configurations such as those illustrated in FIGS. 4-17 may also be used. Step Two is the creation of near-well bore complex fracture networks schematically illustrated at 134, 136 and 138 created for each of three fracture intervals 21, 22 and 23, respectively, by hydraulic fracturing.

Figure 19:
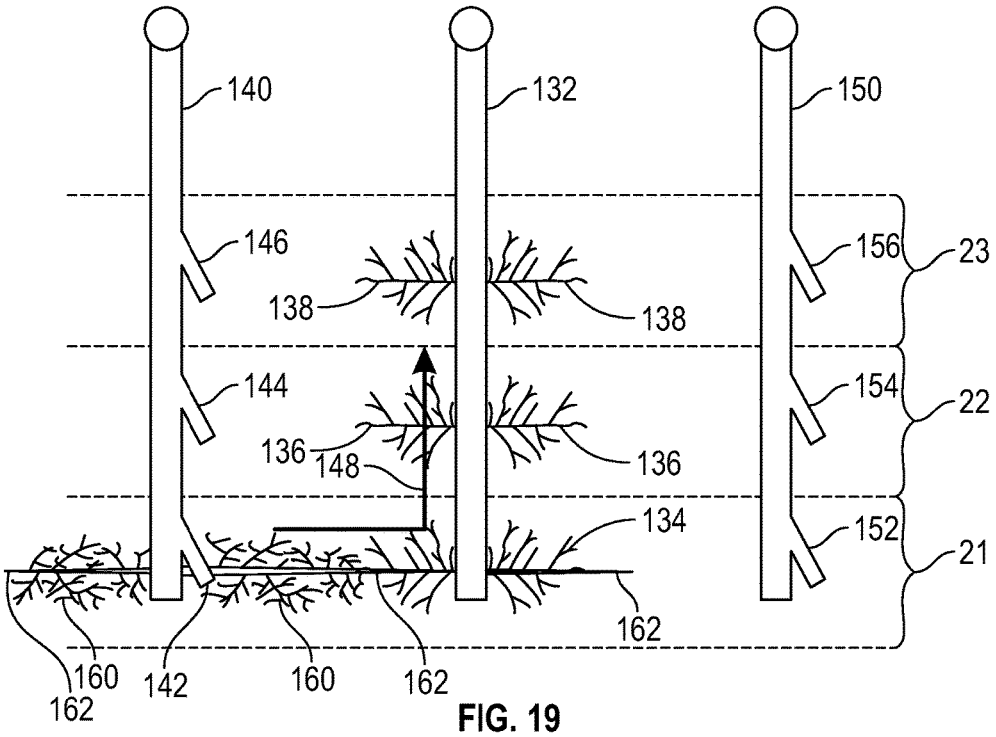
FIG. 19 is a top down, plan sectional view of the configuration of FIG. 18 illustrating that a complex fracture network and a planar fracture has been created from the most distal kick-off wellbore of the assisting lateral wellbore on the left into the fracture network of the most distal, first interval of the primary lateral wellbore, where inducing closure is indicated by the arrow.

Step Three includes creating by hydraulic fracturing a complex fracture network 160 and at least one planar fracture 162 extending from kick-off wellbore 142 (extending from assisting lateral wellbore 140) into the complex fracture network 134 at primary lateral wellbore 132, as illustrated in FIG. 19. Parallel assisting lateral wellbore 140, complex fracture network 160, at least one planar fracture 162, near-wellbore complex fracture network 134 and primary lateral wellbore 132 would thus all be in fluid communication. There may be numerous parameters that can be changed or utilized to improve the process and/or effectiveness of Step Three, creating fluid communications between adjoining one or more laterals, such as, but not necessarily limited to: volume of all treatment fluids, distance between lateral wellbores, fluid pump rates, number of perforations per fracture interval, length or width of frac intervals (e.g. widths of intervals 21, 22, and 23), viscosity of pad fluid and proppant slurry stages, proppant concentrations, proppant specific gravities, and the like, and combinations thereof.

Step Four includes inducing closure of at least one planar fracture 162 and complex fracture networks 134 and 160 by drawing the fracturing fluid and any other treatment fluid in the direction of arrow 148 to be removed by primary lateral wellbore 132, as illustrated in FIG. 19. It should be remembered that typically the major plane of at least one planar fracture 162 is generally perpendicular to the plane of FIG. 19, that is, it extends both toward and away from the viewer and is generally on edge to the viewer.

Figure 20:
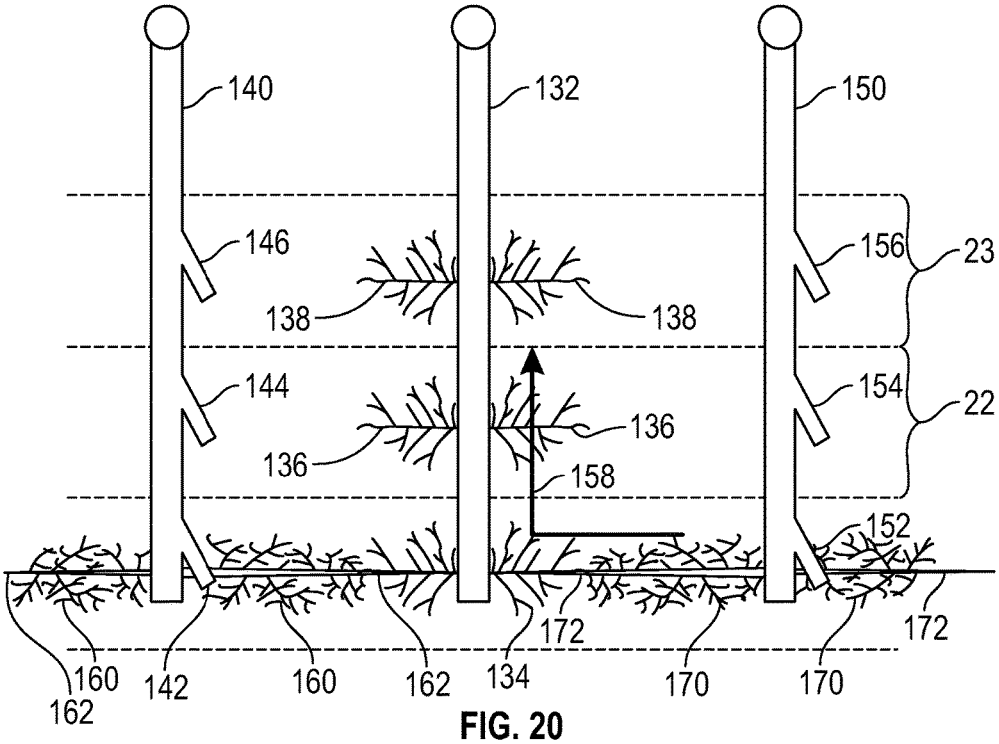
FIG. 20 is a top down, plan sectional view of the configuration of FIG. 19 illustrating that a complex fracture network and a planar fracture has been created from the most distal kick-off wellbore of the assisting lateral wellbore on the right into the fracture network of the most distal, first interval of the primary lateral wellbore, where inducing closure is indicated by the arrow.

Step Five involves creating by hydraulic fracturing a complex fracture network 170 and at least one planar fracture 172 extending from kick-off wellbore 152 (extending from assisting lateral wellbore 150) into the complex fracture network 134 at primary lateral wellbore 132 for interval 21, as shown in FIG. 20. Parallel assisting lateral wellbore 150, complex fracture network 170, at least one planar fracture 172, near-wellbore complex fracture network 134 and primary lateral wellbore 132 would thus all be in fluid communication. Step Six is similar to Step Four and includes inducing closure of at least one planar fracture 172 and complex fracture networks 170 and 134 by drawing the fracturing fluid and any other treatment fluid in the direction of arrow 158 to be removed by primary lateral wellbore 132, as illustrated in FIG. 20.

Figure 21:
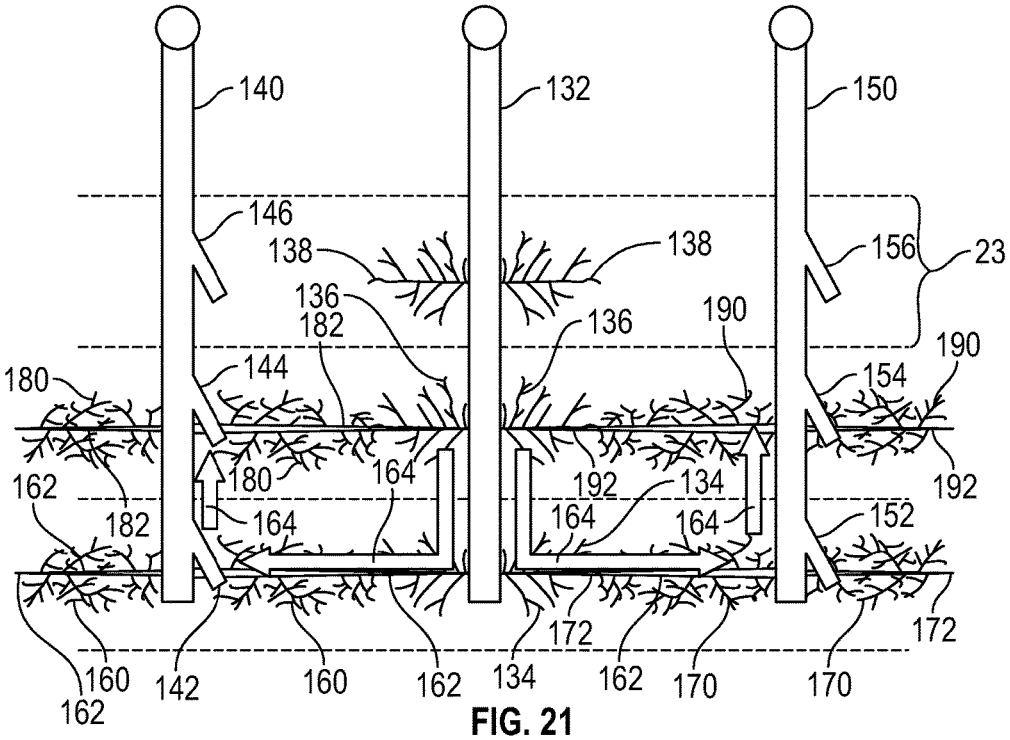
FIG. 21 is a top down, plan sectional view of the configuration of FIG. 20 where fracture networks and a planar fracture has been created for the next, second fracture interval where an isolation packer has been used in the primary lateral wellbore to permit cleanup of the fracture networks of the most distal, first fracture interval.

Step Seven involves repeating Steps Three through Six for the other frac intervals 22 and 23. FIG. 21 is a schematic illustration after hydraulic fracturing has been performed from kick-off wellbore 144 to create complex fracture network 180 and at least one planar fracture 182 extending from kick-off wellbore 144 to near-wellbore complex fracture network 136, so that parallel assisting lateral wellbore 140, kick-off wellbore 144, complex fracture network 180 at least one planar fracture 182, near-wellbore complex fracture network 136 and primary lateral wellbore 132 are all in fluid communication. Similarly, FIG. 21 also schematic illustrates the result after hydraulic fracturing has been performed from kick-off wellbore 154 to create complex fracture network 190 and at least one planar fracture 192 extending from kick-off wellbore 154 to near-wellbore complex fracture network 136, so that parallel assisting lateral wellbore 150, kick-off wellbore 154, complex fracture network 190 at least one planar fracture 192, near-wellbore complex fracture network 136 and primary lateral wellbore 132 are all in fluid communication. Similarly, closure of complex fracture network 180, at least one planar fracture 182, near-wellbore complex fracture network 136, complex fracture network 190 and at least one planar fracture 192 has been similarly induced as in Step Six illustrated in FIG. 20.

Step Eight includes, in one suitable, non-limiting embodiment, using isolation packers in parallel lateral assisting wells 140 and 150 to aid in the cleanup process of the complex fracture networks 160, 134 and 170 and planar fractures 162 and 172 for interval 21 by flushing with a fluid in the reverse direction of fracture treatment fluid flows from parallel lateral wells 140 and 150: from primary lateral wellbore 132 in the direction of white arrows 164 through near-well bore complex fracture network 134, planar fractures 162 and 172, complex fracture networks 160 and 170 and parallel lateral assisting wells 140 and 150, respectively. It is reasonable to expect fracture treatment fluid damage and reservoir hydrocarbon production impairment may be significantly reduced by practice and optimization of eight-step process described herein.

Again, it will be appreciated that in the embodiments shown in FIGS. 18-21 that the kick-off wellbores 142, 144, 146, 152, 154 and 156 may take the shape of kick-off wellbores directed to run parallel to parallel assisting lateral wellbores 140 and 150, respectively, having the shape of kick-off wellbore 48 in FIG. 1. The length and diameter of the kick-off wellbores will depend on reservoir characteristics and the goals of the treatment.

Again, since the fracture networks and planar fractures grow and extend from a secondary wellbore, such as the kick-off wellbores, at the end of the treatments minor underdisplacement of treatment fluid may be utilized, leaving sand-laden fracturing fluid within the kick-off lateral wellbore and not in the primary lateral wellbore. If the kick-off lateral wellbore is oriented downwards, then production of proppant into the primary lateral wellbore should be at a minimum, if any. Additionally, use of more than one kick-off lateral wellbore per frac interval may allow more aggressive proppant concentrations at the latter proppant stages with less concern of premature screenout to further improve wellbore fracture conductivity. In one non-limiting example, proppant slurry entry or injection into the wellbore fracture(s) may occur simultaneously from both kick-off lateral wellbores, where if one wellbore screenout occurs, then proppant slurry injection can continue into the wellbore fracture(s) of the additional kick-off lateral wellbore. During the flush stage, the kick-off wellbore and frac interval may be isolated with a ball-drop tool, sliding sleeve tool, or other tool. These fracturing techniques may also be used for refracturing shale horizons, where past fracturing treatments were poor designs that resulted in limited reservoir production.

Figure 22:
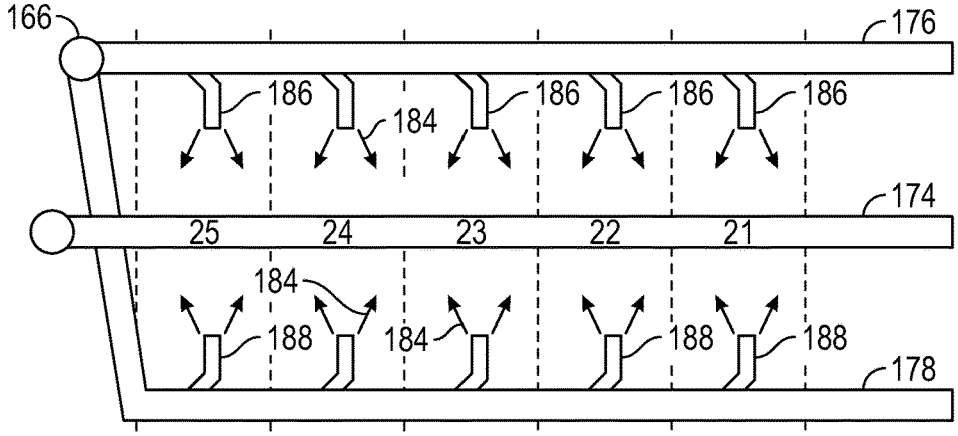
FIG. 22 is a top down, plan section view of a primary lateral wellbore having two assisting lateral wellbores, one on either side of the primary lateral wellbore substantially adjacent thereto and substantially parallel thereto schematically illustrating fracture plane wellbores extending from the parallel assisting lateral wellbores and fracturing fluid injection from the parallel assisting lateral wellbores.

FIG. 22 presents a top down, plan section view of a primary lateral wellbore 174 having two assisting parallel lateral wellbores 176 and 178, one on either side of the substantially adjacent thereto and substantially parallel thereto. The two assisting lateral wellbores 176 and 178 come from the same vertical wellbore 166, and are thus examples of multibranched lateral wellbores. The two assisting lateral wellbores 176 and 178 have a plurality of fracture interval injection lateral wellbores 186 and 188, respectively. While these fracture interval injection lateral wellbores 186 and 188 are roughly shown as perpendicular to the assisting lateral wellbores 176 and 178 from which they come (roughly parallel to anticipated primary hydraulic fractures), they may be at other angles, but should generally be aimed toward the primary lateral wellbore 174. The location of fracture interval injection lateral wellbores 186 and 188 within each fracture interval may generally be aimed or offset aligned with the location of perforations in lateral wellbore 174, and aimed or aligned directly with the anticipated hydraulic primary fracture(s) to extend from lateral wellbore 174 in each fracture interval. The fracture interval injection lateral wellbores 186 and 188 may range in length (i.e. from assisting lateral wellbores 176 and 178) from about 50 feet (about 15 m) independently to about 1000 feet (305 m) long, and may be adjusted on the fly (during drilling). The length may depend upon several reservoir completion and stimulation factors. These fracture interval injection lateral wellbores 186 and 188 may also optionally extend from the primary lateral wellbore 174, although they are not illustrated to be in FIG. 22. A complex fracture network (not shown) may be created and extend from the ends of the fracture interval injection lateral wellbores 186 and 188. In other suitable embodiments, complex fracture networks are created along assisting lateral wellbores 176 and 178 near fracture interval injection wellbore laterals 186 and 188, or the complex fractures are created at one or more points along the length of fracture interval injection lateral wellbores 186 and 188. FIG. 22 further schematically illustrates fracturing fluid injection in the direction of the arrows 184 being pumped from the parallel assisting lateral wellbores 176 and 178. Following hydraulic fracturing, cleanup fluids (e.g. gases such as $N_2$ and $CO_2$) may be injected in the direction of the arrows 184, and other aqueous chemical treatment fluids formulated for fracture network cleanup, including foamed fluids, may also be injected along the paths of the arrows 184 (and other paths) shown in FIG. 22. The recovery of the fracture treatment fluids will have improved energy in the reservoir to migrate to primary and enter lateral wellbore 174 during cleanup injection from fracture interval injection wellbore laterals 186 and 188. Methods of fluid diversion into the complex fracture networks during cleanup fluid injection, in many cases, will improve total fracture treatment fluid recovery from the fracture intervals as fluids ultimately enter and are produced from primary lateral wellbore 174 during the cleanup process.

Figure 23:
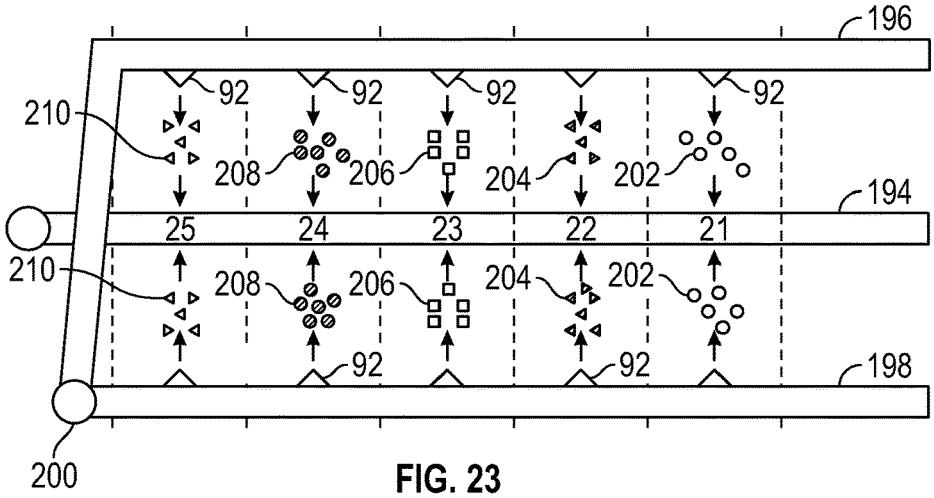
FIG. 23 is a top down, plan section view of a primary lateral wellbore having two assisting lateral wellbores, one on either side of the primary lateral wellbore substantially adjacent thereto and substantially parallel thereto schematically illustrating the injection of tracer chemicals into the far-field regions of the intervals.

FIG. 23 is a top down, plan section view of a primary lateral wellbore 194 having two assisting parallel lateral wellbores 196 and 198, one on either side of the primary lateral wellbore 194 substantially adjacent thereto and substantially parallel thereto, where the two assisting lateral wellbores 196 and 198 extend from the same vertical wellbore 200. Perforations or fracture interval injection and pressure release ports 92 are indicated in the two assisting lateral wellbores 196 and 198 generally aimed in the direction of primary lateral wellbore 194. FIG. 23 also schematically illustrating the injection of tracers or tracer chemicals 202, 204, 206, 208 and 210 into the far-field regions of the intervals, although they may enter the primary lateral wellbore 194 through openings therein, but which openings are sufficient to identify from which frac interval 21, 22, 23, 24 or 25 they came from. The analysis of the tracers 202, 204, 206, 208 and 210 produced from primary lateral wellbore 194, which are unique to each frac interval, 21-25, may indicate conditions within the frac intervals including, but not necessarily limited to, conductivity, flow rates, flow pressures, fracture network complexity, higher hydrocarbon producing fracture intervals along primary lateral 194, diagnostic information of fracture intervals 21-25, production when fractures are treated differently (i.e. treatment pump rate, number of perforation clusters per fracture interval, width of fracture interval, volume of pad and proppant slurry stages), types and/or combination of treatment fluids (i.e. slickwater, VES, linear polymer, crosslinked polymer, foamed fluid, and the like), total proppant placed in the intervals, comparison of long term scale prevention additive effects (e.g. one or two intervals utilizing a slow release inhibitor agent like ScaleSORB™ available from Baker Hughes Incorporated and other zones completed without inhibitor), type of cleanup fluid formulation, type of cleanup process from assisting lateral wellbores 196 and 198, comparison of intervals that were quickly forced to fracture closure contrasted with intervals allowed to fracture close naturally over days, production information for use in refrac candidate selection), and the like. Conventionally tracers such as 202, 204, 206, 208 and 210 come from the primary wellbore 194, not assisting lateral wellbores 196 and 198, which of course are normally not present. Introduction of tracers such as 202, 204, 206, 208 and 210 may be done at any time in the methods described herein that include at least one assisting lateral wellbore. In another non-limiting embodiment, various diagnostic processes and/or treatments may be performed on the multiple fracture intervals where other diagnostic techniques can be used with or without tracers for gaining diagnostic knowledge about how treatments and processes perform to optimize completing and producing the geo-specific shale reservoir.

Figure 24:
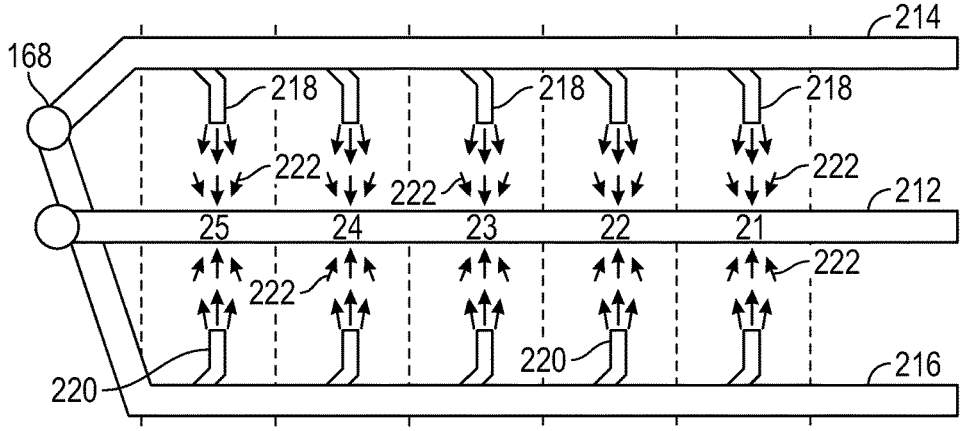
FIG. 24 is a top down, plan section view of a primary lateral wellbore having two assisting lateral wellbores, one on either side of the primary lateral wellbore substantially adjacent thereto and substantially parallel thereto schematically illustrating fracture plane wellbores extending from the parallel assisting lateral wellbores and showing water-block removal from the parallel assisting lateral wellbores which may include "reverse diversion" aspects.

Shown in FIG. 24 is a top down, plan section view of a primary lateral wellbore 212 having two assisting parallel lateral wellbores 214 and 216, one on either side of the primary lateral wellbore 212 substantially adjacent thereto and substantially parallel thereto schematically illustrating fracture plane wellbores 218 and 220 extending from the parallel assisting lateral wellbores 214 and 216, respectively. Assisting parallel lateral wellbores 214 and 216 may come from the same vertical wellbore 168. The arrows 222 indicate generally the flow of paraffin inhibitors or scale inhibitors or asphaltene inhibitors or other chemical additive, as needed during production. It may be that a particular chemical additive is needed in only one or selective frac intervals 21-25 in which case the other intervals are temporarily isolated therefrom. The additives may also be distributed via pathways 222 as needed. Chemicals may be introduced along pathways 222 that are used to remove water blocks. In the past, chemicals had to be introduced in the primary wellbore, and even if encapsulated or absorbed to be released over time, may only last six months or a year. With the use of parallel assisting lateral wellbores such as 214 and 216, there is the option of continuous or intermittent or regular chemical injection in to the fractured intervals over time as needed. Further, conventional and future diversion strategies may be implemented from parallel assisting lateral wellbores such as 214 and 216, which may be understood as "reverse diversion" since typically diversion occurs in a direction coming from the primary wellbore.

In shale reservoir cleanup after hydraulic fracture treatments, a return of 10-20 vol % of the hydraulic fracture treatment fluid is considered good. The rest of the fluid is retained in the formation for various reasons and may cause formation damage of various types that restrict and/or reduce hydrocarbon production immediately and/or sometime after the fracture treatment. The use of parallel assisting lateral wellbores can help remove much more of these fluids and increase the unloading percentages of the treatment fluids, thus helping remove as much fluid as possible to inhibit or prevent or reduce them from causing possible damage. Returns of about 30 vol % or more, alternatively about 40 vol % or more, and in another non-limiting embodiment about 60 vol % or more are expected with the configurations and methods described herein.

Figure 25:
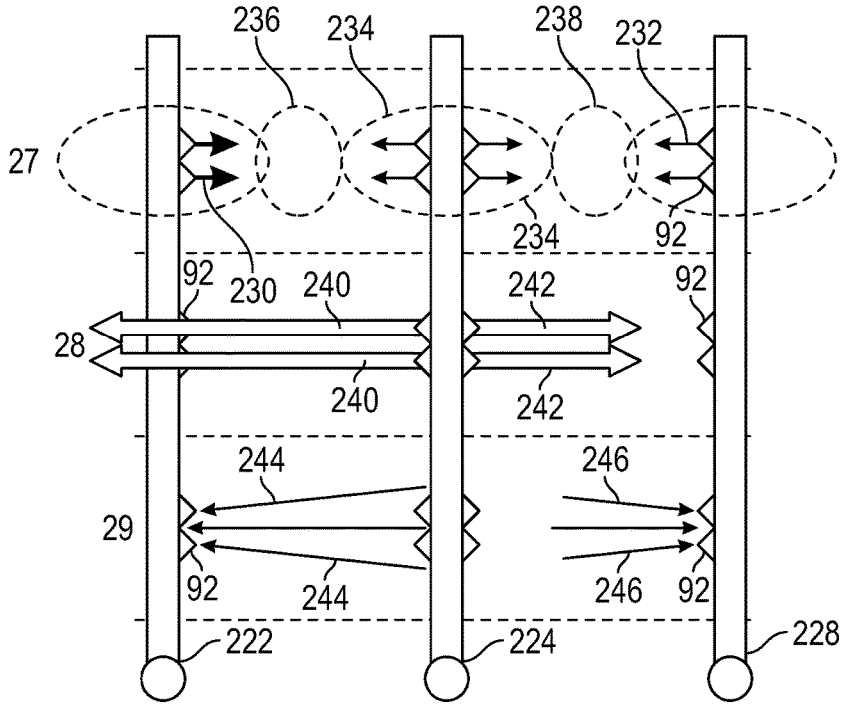
FIG. 25 is a top down, plan section view of a primary lateral wellbore having two assisting lateral wellbores, one on either side of the primary lateral wellbore substantially adjacent thereto and substantially parallel thereto schematically illustrating factors involved in determining the lateral spacing of such wellbores.

Shown in FIG. 25 is a top down, plan section view of a primary lateral wellbore 224 having two assisting lateral wellbores 226 and 228, one on either side of the primary lateral wellbore 224 substantially adjacent thereto and substantially parallel thereto schematically illustrating factors involved in determining the lateral spacing of such wellbores. Frac interval 27 illustrates that reservoir characteristics for near wellbore fracture network complexity and far-field network complexity should be considered. On the left side of frac interval 27, heavy arrows 230 indicate a further reach into the far-field region (relatively greater network complexity) as compared with lighter arrows 232 on the right side of frac interval 27 indicating a shorter reach into the far-field region (relatively lesser network complexity). Thus, for equivalent reach of network complexity from primary lateral wellbore 224, as indicated at region and arrows 234, the far-field network complexity 236 on the left will be larger and more well connected than the far-field network complexity 238 on the right. Thus, from this example, it should be considered that assisting lateral wellbore 228 should be placed closer to primary lateral wellbore 224 than should assisting lateral wellbore 226. Stated another way, on the left side of frac interval 27, the pressures from assisting lateral wellbore 226 and primary lateral wellbore 224 meet more completely in the far-field network to create more complexity, in contrast with the pressures from assisting lateral wellbore 228 and primary lateral wellbore 224 which meet less completely in the far-field network and which create lesser complexity.

Shown in frac interval 28 of FIG. 25, on the left long arrows 240 indicate the ability to generate long conductive planar fractures so that there is a direct connection formed between primary lateral wellbore 224 and assisting lateral wellbore 226. In contrast shorter arrows 242 on the right indicate a reduced ability to generate long conductive planar fractures so that there is no direct connection formed between primary lateral wellbore 224 and assisting lateral wellbore 228. Again, given these relative factors, assisting wellbore 228 may need to be placed closer to primary lateral wellbore 224 compared to assisting lateral wellbore 226.

Shown in frac interval 29 of FIG. 25, on the left are long arrows 244 indicating the ability to close a proppant-laden fracture network, relatively short fracture network closure time, relatively higher volumes and pressure over time so that the proppant is desirably placed without settling, as compare with the shorter arrows 246 on the right that indicate a longer fracture closure time, relatively lower volumes and/or lower pressures. On the left side of frac interval 29, closing the fracture network around primary lateral wellbore 224 is readily accomplished while on the right side of frac interval 29, not all of the pressure around primary lateral wellbore 224 may be released. Again, given these relative factors, assisting wellbore 228 may need to be placed closer to primary lateral wellbore 224 compared to assisting lateral wellbore 226. Additionally, differences in the efficiency of fracture network cleanup procedures will affect lateral well spacing.

Figure 26:
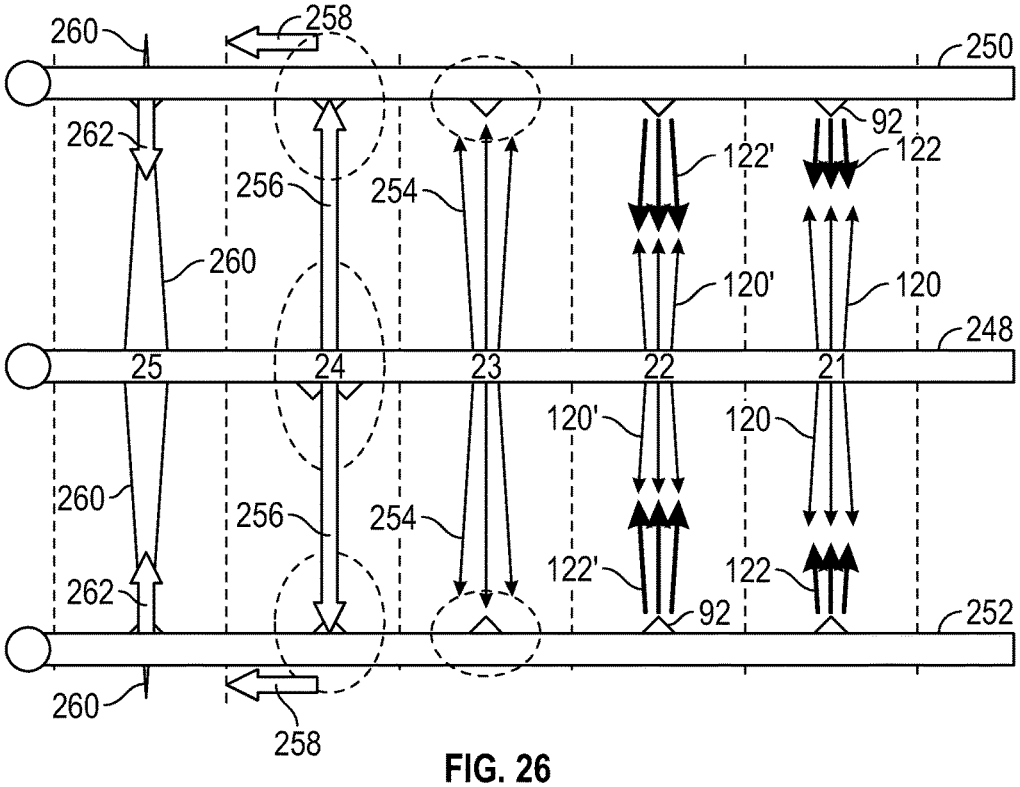
FIG. 26 is a top down, plan section view of a primary lateral wellbore having two assisting lateral wellbores, one on either side of the primary lateral wellbore substantially adjacent thereto and substantially parallel thereto schematically illustrating bi-directional fracturing treatments.

FIG. 26 presents a top down, plan section view of a primary lateral wellbore 248 having two assisting lateral wellbores 250 and 252, one on either side of the primary lateral wellbore 248 substantially adjacent thereto and substantially parallel thereto schematically illustrating bi-directional fracturing treatments, fracture network closure, and fracture network cleanup. Frac intervals 21 and 22 schematically illustrates differences in fracturing fluid injection (rate, pressure and/or viscosity) from the primary lateral wellbore 248 by arrows 120 and from the parallel assisting lateral wellbores 250 and 252 by arrows 122. As shown for frac interval 21, the fracturing flow from primary lateral wellbore 248 has a higher rate, higher injection pressure and/or uses higher viscosity (e.g. no gas in the initial slickwater used) as indicated by the longer arrows 120 as compared with the smaller, darker arrows 122. This will accomplish more far-field pressure diversion and network complexity, where "far-field" is defined as away from primary lateral wellbore 248. Looking at frac interval 22, the arrows 120' are only slightly longer than arrows 122' indicating that the frac fluid flow from primary lateral wellbore 110 has a slightly higher rate, injection pressure and/or viscosity (e.g. no gas in the initial slickwater used) which will accomplish more overall network complexity. This part of FIG. 26 is comparable to FIG. 15 previously discussed.

Shown at interval 23 of FIG. 26, arrows 254 indicate that all of the pressure is released from around primary lateral wellbore 248 resulting in the closure of fracture networks around it. Nothing is injected from primary lateral wellbore 248 but fluid is withdrawn from the networks at perforations or fracture interval injection and pressure release ports 92 in assisting lateral wellbores 250 and 252.

In contrast, at interval 24 of FIG. 26, treatment fluids are injected from primary lateral wellbore 248 in the direction of white arrows 256, but these fluids are also drawn down (i.e. creating lower wellbore pressure within assisting lateral wellbores 250 and 252) from the fracture network in the direction of white arrows 258.

At interval 25 of FIG. 26, planar fracture 260 is formed by the injection of a slickwater, linear gel, and/or crosslinked gel fracturing fluid from primary lateral wellbore 248 followed by, in one non-limiting example, the injection of a gas in the opposite direction for cleanup, such as $N_2$ or $CO_2$ in the direction of white arrows 262. In other non-limiting embodiments gas and aqueous fluid in various combinations, and/or aqueous fluids of various formulations can be the injection fluids. The use of assisting lateral wellbores 250 and 252 provides better displacement of the fracturing fluid, in contrast with relying primarily on natural reservoir pressures and production energy when only a conventional mono-bore-reservoir fracturing treatment structure is used for treatment fluid cleanup.

It will be apparent from FIG. 26 and the discussion thereof, as well as the discussion of other Figures, that the methods herein of using one or more assisting lateral wellbores, such as 250 and 252, provide a number of options, including, but not necessarily limited to, initiating fracturing with the assisting lateral wellbores, pre-treating the formation from the assisting lateral wellbores, releasing treatment pressures using the assisting lateral wellbores, injecting fracturing fluids and treatment fluids simultaneously from different directions into the far-field regions with the same or varying injection rates, stage volumes, fluid viscosity, material diverters, proppant sizes, proppant concentrations and the like, as well as drawing down wellbore and associated reservoir area pressures using the assisting lateral wellbores.

The use of one or more parallel assisting lateral wellbores that are in fluid communication (i.e. through fracture complexity or networks and/or through propped fractures) with an adjacent primary lateral wellbore can provide a dimension of control and customization that is not possible with a primary lateral wellbore alone, that is, a conventional mono-bore approach. The parallel assisting lateral wellbores may assist in a wide range of shale treatments, including, but not necessarily limited to, hydraulic fracturing, the ability to control fracture closure, introduction and removal of fracture treatment fluids, production optimization treatments, more control over fracture network development, geometry, productivity and refracturing treatments of shale intervals. Improvements in the ability to distribute rock stress, treatment pressure, treatment fluid, diversion fluid or agents, cleanup agents, placement of treatment additives, improving near-wellbore and/or far-field propped fracture network conductivity, connection of propped primary wellbore fracture extension to far-field fracture networks, connection of propped assisting wellbore fracture extension to far-field fracture networks, and combinations of these.

Improvements that may be obtained using the lateral wellbores, kick-off wellbores and secondary and/or assisting lateral wellbores include, but are not necessarily limited to improving the character and complexity of hydraulic fracture networks, improving the ability to control fracture closure, improving treatments and processes for fracture treatment fluids, improving fracture network cleanup, improving production optimization treatments, and improving the refracturing treatments of shale intervals. Techniques of fracturing adjacent wellbores may help in the distribution of rock stress, treatment pressure, treatment fluid, diversion fluids or agents, clean-up agents, placement of treatment improvement additives, improving far-field propped fracture conductivity, and/or connection of propped primary wellbore fracture extension to far-field fracture networks.

In the foregoing specification, the invention has been described with reference to specific embodiments thereof, and has been demonstrated as effective in providing methods and compositions for improving the recovery of hydrocarbons from subterranean formation that have been hydraulically fractured. However, it will be evident that various modifications and changes can be made thereto without departing from the broader scope of the invention as set forth in the appended claims. Accordingly, the specification is to be regarded in an illustrative rather than a restrictive sense. For example, the number and kind of primary and/or assisting lateral wellbores, fracturing, cleanup and treatment procedures, specific fracturing fluids, cleanup fluids and gases, treatment fluids, fluid compositions, viscosifying agents, proppants and other components falling within the claimed parameters, but not specifically identified or tried in a particular composition or method, are expected to be within the scope of this invention. Further, it is expected that the primary and lateral assisting wellbores and procedures for fracturing, treating and cleaning up fracture networks may change somewhat from one application to another and still accomplish the stated purposes and goals of the methods described herein. For example, the methods may use different components, fluids, wellbores, component combinations, different fluid and component proportions and additional or different steps than those described and exemplified herein.

The words "comprising" and "comprises" as used throughout the claims is to be interpreted as "including but not limited to".

The present invention may suitably comprise, consist or consist essentially of the elements disclosed and may be practiced in the absence of an element not disclosed. For instance, there may be provided a method for improving a flow of a hydrocarbon from at least one lateral wellbore in a subterranean shale formation having at least one assisting lateral wellbore substantially adjacent to and substantially parallel to the primary lateral wellbore, where the method consists essentially of or consists of hydraulically fracturing at least one first shale interval in the formation from the at least one primary lateral wellbore in the direction of the at least one assisting lateral wellbore to create a first fracture network; hydraulically fracturing the at least one first shale interval from the at least one assisting lateral wellbore in the direction of the at least one primary lateral wellbore bore to create a second fracture network where the second fracture network and the first fracture network are in fluid communication with each other; a sub-method selected from the group consisting of: (1) cleaning up the at least one primary lateral wellbore comprising introducing a cleanup fluid from the at least one assisting lateral wellbore through the second fracture network into the first fracture network and the at least one primary lateral wellbore to remove at least one contaminant or frac treatment material therefrom; (2) inducing closure of at least one fracture of the first fracture network by withdrawing fluid from the first fracture network, by causing fluid flow towards and/or into the second fracture network, and towards and/or into the at least one assisting lateral wellbore; (3) treating the first fracture network and the second fracture network with a treatment fluid; and (4) combinations thereof, where the method also consists essentially of or consists of producing a hydrocarbon from at least one lateral wellbore.

Alternatively, a method is provided for improving a flow of a hydrocarbon from at least one primary lateral wellbore in a shale interval in a subterranean formation, where the method consists essentially of or consists of drilling at least one kick-off wellbore in the shale interval away from the at least one primary lateral wellbore; hydraulically fracturing the shale interval from the kick-off wellbore; simultaneously with or subsequent to the hydraulically fracturing, introducing a proppant-laden fluid into the at least one primary lateral wellbore and the at least one kick-off wellbore; and subsequent to the introduction of the proppant-laden fluid, introducing a flush fluid into the at least one primary lateral wellbore and the at least one kick-off wellbore such that displacement of the flush fluid causes the proppant-laden fluid to be placed into the at least one kick-off wellbore preferential to the at least one primary lateral wellbore.

There may also be provided a method for improving a flow of a hydrocarbon from at least one primary lateral wellbore in a subterranean shale formation of a reservoir having at least one shale interval, where the method consists essentially of or consists of drilling a plurality of kick-off wellbores in the shale interval away from the at least one primary lateral wellbore, each of the kick-off wellbores being located in a respective fracturing stage interval, where at least two of the kick-off wellbores are not parallel relative to each other, hydraulically fracturing the shale interval from each kick-off wellbore to create a respective primary fracture network in each respective fracturing stage interval, crossing a portion of the reservoir with at least one primary fracture network to intersect at least one sweet-spot horizon by the cross-interval landing of at least one kick-off wellbore, and drilling at least one additional kickoff wellbore into the at least one sweet-spot horizon and hydraulically fracturing the shale interval from the at least one additional kick-off wellbore to create an additional respective fracture network in an additional fracturing stage interval.

There is additionally provided a method for improving a flow of a hydrocarbon from at least one primary lateral wellbore in a subterranean shale formation and at least two assisting lateral wellbores substantially adjacent to and substantially parallel to the primary lateral wellbore, where the method consists essentially of or consists of hydraulically fracturing a completion plan series of fracture intervals of at least one first shale interval in the formation from the at least one primary lateral wellbore and the at least two assisting lateral wellbores to create a near to far-field fracture network around each primary lateral wellbore and the at least two assisting lateral wellbores, where the near to far-field fracture networks around the at least two assisting laterals are created prior to or simultaneously with the creation of a near to far-field fracture network around each primary lateral wellbore, where in the case of simultaneous creation, then the method further comprises subsequently stopping hydraulic fracturing from the at least two assisting lateral wellbores at the at least one first shale frac interval, to then continue hydraulically fracturing from the primary lateral wellbore to intersect with proppant-laden fluid at least one of the two assisting lateral wellbores near wellbore fracture networks and intersecting one or both assisting lateral wellbores with the proppant-laden slurry from the primary lateral wellbore. The method further consists essentially of or consists of intersecting at least one of the at least two assisting lateral wellbores near wellbore fracture networks and/or assisting lateral wellbores from the primary lateral wellbore with the proppant-laden slurry fracturing fluid to produce a conductive fracture or fracture network between the primary lateral wellbore and at least one of the at least two assisting lateral wellbores or fracture networks extending therefrom.

What is claimed is:

1. A method for improving a flow of a hydrocarbon from at least one primary lateral wellbore in a subterranean shale formation having at least one assisting lateral wellbore substantially adjacent to and substantially parallel to the primary lateral wellbore, where the method comprises:

hydraulically fracturing at least one first shale interval in the formation from the at least one primary lateral wellbore in the direction of the at least one assisting lateral wellbore to create a first fracture network;

hydraulically fracturing the at least one first shale interval from the at least one assisting lateral wellbore in the direction of the at least one primary lateral wellbore to create a second fracture network where the second fracture network and the first fracture network are in fluid communication with each other; and a sub-method comprising:

(1) cleaning up the at least one primary lateral wellbore comprising introducing a cleanup fluid from the at least one assisting lateral wellbore through the second fracture network into the first fracture network and the at least one primary lateral wellbore to remove at least one contaminant or frac treatment material therefrom; and (2) placing proppant In at least the first fracture network and inducing closure of at least one fracture of the first fracture network by withdrawing fluid from the first fracture network, by causing fluid flow towards and/or into the second fracture network, and towards and/or into the at least one assisting lateral wellbore; and producing the hydrocarbon from at least one lateral wellbore.

2. The method of claim 1 where the at least one primary lateral wellbore and the at least one assisting lateral wellbore are:

within about 50 to about 1200 feet (about 15 to about 366 meters) of each other, and within 0 to about 8° of the same angle as each other.

3. The method of claim 1 where in the sub-method (1) the cleanup fluid comprises a component selected from the group consisting of water, an inert gas, at least one tracer, at least one treating chemical, KCl, KCl substitutes, clay inhibitors, clay control agents, corrosion inhibitors, iron control agents, mutual solvents, water wetting surfactants, foaming agents, microemulsions, alkyl silanes, biocides, polymer breakers, non-emulsifiers, reducing agents, chelating agents, organic acids, esters, resins, mineral acids, viscoelastic surfactants, breakers for viscoelastic surfactants, polymeric-based friction reducers, inorganic nanoparticles, organic nanoparticles, salts, scale inhibitors, pH buffers, and combinations thereof.

4. The method of claim 1 further comprising drilling at least one kick-off wellbore from a wellbore selected from the group consisting of the at least one primary lateral wellbore, the at least one assisting lateral wellbore, and both.

5. The method of claim 4 further comprising hydraulic fracturing the at least one shale interval from the at least one kick-off wellbore to create a kick-off fracture network in the direction of a fracture network selected from the group consisting of the first fracture network and/or the second fracture network, to be in fluid communication therewith.

6. The method of claim 4 where the at least one kick-off wellbore has a length that is substantially parallel to the wellbore from which it comes.

7. The method of claim 1 where:

the at least one primary lateral wellbore and the at least one assisting lateral wellbore each have a heel and toe with a lateral wellbore length between the heel and toe;

the at least one first shale interval is near the toe of the at least one primary lateral wellbore and the at least one assisting lateral wellbore, the at least one primary lateral wellbore and the at least one assisting lateral wellbore being within the at least one first shale interval;

there is present a second shale interval between the first shale interval and the heel of the at least one primary lateral wellbore and the at least one assisting lateral wellbore, the at least one primary lateral wellbore and the at least one assisting lateral wellbore being within the second shale interval;

where the method further comprises:

temporarily isolating a portion of the at least one primary lateral wellbore within the at least one first shale interval from the second shale interval;

temporarily isolating a portion of the at least one assisting lateral wellbore within the at least one first shale interval from the second shale interval;

hydraulically fracturing second shale interval from the at least one primary lateral wellbore in the direction of the at least one assisting lateral wellbore to create a third fracture network;

hydraulically fracturing the second shale interval from the at least one assisting lateral wellbore in the direction of the at least one primary lateral wellbore to create a fourth fracture network where the third fracture network and the fourth fracture network are in fluid communication with each other;

a sub-method selected from the group consisting of:

(1) cleaning up the at least one primary lateral wellbore comprising introducing a cleanup fluid from the at least one assisting lateral wellbore through the fourth fracture network into the third fracture network and the at least one primary lateral wellbore to remove at least one contaminant therefrom;

(2) placing proppant in at least the third fracture network and inducing closure of closure of the third fracture network by withdrawing fluid from the fourth fracture network, the third fracture network and at least one assisting lateral wellbore;

(3) treating the third fracture network and the fourth fracture network with a treatment fluid; and (4) combinations thereof.

8. The method of claim 1 where at least some of the hydraulic fracturing comprises a stop/start-low viscosity/high viscosity staged diversion process to create complex fractures.

9. The method of claim 1 further comprising creating at least one planar fracture extending from the at least one primary lateral wellbore in the direction of the at least one assisting lateral wellbore so that the first fracture network, the second fracture network, and the planar fracture are in fluid communication with each other.

10. A method for improving a flow of a hydrocarbon from at least lateral wellbore in a shale interval in a subterranean formation, where the method comprises:

from the primary lateral wellbore, drilling at least one kick-off wellbore in the shale interval away from the at least one primary lateral wellbore and/or the at least one assisting lateral wellbore;

hydraulically fracturing the shale interval from the kick-off wellbore;

simultaneously with or subsequent to the hydraulically fracturing, introducing a proppant-laden fluid into the at least one kick-off wellbore and at least one of the at least one primary lateral wellbore and/or the at least one assisting lateral wellbore; and subsequent to the introduction of the proppant-laden fluid, introducing a flush fluid into the at least one kick-off wellbore and at least one of the at least one primary lateral wellbore and/or the at least one assisting lateral wellbore and such that displacement of the flush fluid causes the proppant-laden fluid to be placed into the at least one kick-off wellbore preferential to the at least one primary lateral wellbore and/or the at least one assisting lateral wellbore.

11. The method of claim 10 where the at least one kick-off wellbore is oriented downward from the at least one primary lateral wellbore.

12. The method of claim 10 where the at least one kick-off wellbore has a length that is substantially parallel to the wellbore from which it comes.

13. The method of claim 10 where the method further comprises drilling at least two kick-off wellbores in the shale interval away from the at least one primary lateral wellbore and/or the at least one assisting lateral wellbore; and hydraulically fracturing the shale interval from each of the kick-off wellbores to increase the preferential placement of the proppant-laden fluid into the kick-off wellbores from the at least one primary lateral wellbore and/or the at least one assisting lateral wellbore.

14. The method of claim 10 where prior to or during the introducing a flush fluid into the at least one primary lateral wellbore and the at least one kick-off wellbore, the at least one kick-off wellbore is isolated from the at least one primary lateral wellbore.

15. A method for improving a flow of a hydrocarbon from at least one primary lateral wellbore in a subterranean shale formation and at least two assisting lateral wellbores substantially adjacent to and substantially parallel to the primary lateral wellbore, where the method comprises:

hydraulically fracturing a completion plan series of fracture intervals of at least one first shale interval in the formation from the at least one primary lateral wellbore and the at least two assisting lateral wellbores to create a near to far-field fracture network around each primary lateral wellbore and the at least two assisting lateral wellbores, where the near to far-field fracture networks around the at least two assisting lateral wellbores are created prior to or simultaneously with the creation of a near to far-field fracture network around each primary lateral wellbore, where in the case of simultaneous creation, then the method further comprises subsequently stopping hydraulic fracturing from the at least two assisting lateral wellbores at the at least one first shale frac interval, to then continue hydraulically fracturing from the primary lateral wellbore to intersect with proppant-laden fluid at least one of the two assisting lateral wellbores near wellbore fracture networks and intersecting one or both assisting lateral wellbores with the proppant-laden slurry from the primary lateral wellbore; and intersecting at least one of the at least two assisting lateral wellbores near wellbore fracture networks and/or assisting lateral wellbores from the primary lateral wellbore with the proppant-laden slurry fracturing fluid to produce a conductive fracture or fracture network between the primary lateral wellbore and at least one of the at least two assisting lateral wellbores or fracture networks extending therefrom.

* * * * *